US007017670B2

(12) United States Patent
Hazel et al.

(10) Patent No.: US 7,017,670 B2
(45) Date of Patent: Mar. 28, 2006

(54) APPARATUS AND METHOD FOR EXPANDING AND FIXING A TUBULAR MEMBER WITHIN ANOTHER TUBULAR MEMBER, A LINER OR A BOREHOLE

(75) Inventors: Paul Roderick Hazel, Aberdeen (GB); Espen Hiorth, Trondheim (NO)

(73) Assignee: Read Well Services Limited, (GB)

( * ) Notice: Subject to any disclaimer, the term of this patent is extended or adjusted under 35 U.S.C. 154(b) by 0 days.

(21) Appl. No.: 10/374,609

(22) Filed: Feb. 26, 2003

(65) Prior Publication Data

US 2004/0159445 A1 Aug. 19, 2004

(30) Foreign Application Priority Data

Feb. 13, 2003 (GB) ..... 0303422

(51) Int. Cl.
*E21B 23/02* (2006.01)
*E21B 33/124* (2006.01)

(52) U.S. Cl. ..... 166/382; 166/191; 166/147; 166/384; 166/212; 166/208; 166/242.1; 166/387

(58) Field of Classification Search ..... 166/382, 166/384, 387, 206–208, 118, 120, 122, 127, 166/128, 134, 191, 196, 146, 147, 217, 212, 166/242.1, 207
See application file for complete search history.

(56) References Cited

U.S. PATENT DOCUMENTS 2,159,640 A * 5/1939 Strom ..... 166/122
2,738,017 A * 3/1956 Lynes ..... 277/340
2,812,025 A * 11/1957 Doherty et al. ..... 166/207
3,142,338 A * 7/1964 Brown ..... 166/120
4,749,035 A * 6/1988 Cassity ..... 277/340
5,829,524 A * 11/1998 Flanders et al. ..... 166/277
6,435,281 B1 * 8/2002 Baugh ..... 166/382
6,722,427 B1 * 4/2004 Gano et al. ..... 166/217
2002/0020524 A1 2/2002 Gano
2004/0031615 A1 2/2004 McMahan et al.

FOREIGN PATENT DOCUMENTS

EP 0937861 A2 8/1999
EP 1165933 B1 3/2001
WO WO 00/58601 10/2000

OTHER PUBLICATIONS

Oil States MCS—Hydra-Lok® swaged-liner caisson repair and reinforcement; Copyright 1998, Oil States Industries, Inc., 5 pages.

* cited by examiner

*Primary Examiner*—Kenneth Thompson
(74) *Attorney, Agent, or Firm*—Drinker Biddle & Reath LLP

(57) ABSTRACT

An apparatus for securing a tubular member within a liner or borehole has a seal means connected within the tubular member, and a pressure control device operable to increase the pressure within the tubular member, such that operation of the pressure control means causes the tubular member to move radially outwardly to bear against the inner surface of the liner or borehole wall. Also, a packer for use in a downhole annular space and an isolation plug for plugging a downhole tubular are disclosed.

28 Claims, 20 Drawing Sheets

APPARATUS AND METHOD FOR EXPANDING AND FIXING A TUBULAR MEMBER WITHIN ANOTHER TUBULAR MEMBER, A LINER OR A BOREHOLE

FIELD OF THE INVENTION

The present invention relates to an apparatus and method, particularly but not exclusively, for deploying and/or securing a tubular section referred to as a "tubular member" within a liner or borehole.

BACKGROUND OF THE INVENTION

Oil or gas wells are conventionally drilled with a drill string at which point the open hole is not lined, hereinafter referred to as a "borehole". After drilling, the oil, water or gas well is typically completed thereafter with a casing or liner and a production tubing, all of which from here on are referred to as a "liner".

Conventionally, during the drilling, production or workover phase of an oil, water or gas well, and from a first aspect of the present invention, there may be a requirement to provide a patch or temporary casing across an interval, such as a damaged section of liner, or an open hole section of the borehole.

Additionally, and from a second aspect of the present invention, there may be a requirement to cut a tubular (such as a section of casing) downhole, remove the upper free part and replace it with a new upper length of tubular in an operation know as a "tie back" and in such a situation it is important to obtain a solid metal to metal seal between the lower "old" tubular section and upper "new" tubular section.

Additionally, from a third aspect, the present invention relates to a seal packer for subterranean wells which can be used to isolate two zones in an annular space of such wells, or to join two tubes together, etc.

The use of radially expandable packers is well known in the art. These packers, or seals, are frequently used to do maintenance in areas over the packer, or to seal off a particular formation, for example a water producing zone of the well.

Generally, there are two types of packers, the first type is inflatable rubber packers and the second type is compact rubber packers. The two types have different characteristics when it comes to the expansion ability and temperature and pressure tolerance. Today, even more well environments have high temperature and pressure, and it is a challenge to develop reliable equipment for such environments. The prior art have some disadvantages, for example the high temperature and high pressure can cause extruding of the packer. Consequently, this may result in a leakage. Another disadvantage is that some packers after compression in well bores with extreme temperatures and pressures will not function properly, for example the relaxation of the packer can work poorly.

There have been several attempts to solve the disadvantages mentioned above.

GB Patent Publication No 2296520A describes oil/gas well tools related to a sealing/packing tool which provides a pressure/fluid barrier. It provides a downhole tool comprising at least one ring with petaloid extensions, said ring being disposed about a longitudinal axis of the tool, and means for controllably deforming said petaloid extensions such that said extensions may be controllably moved in use. Said controllable movement may cause the extensions to be brought into close proximity with an inner surface of a conduit. Said tool may further comprise an elastically deformable packing element. The extensions are expanded by a wedge surface on the ring and help to centre the tool in the conduit. The extensions may also be arranged to act as anti extrusion means for the packing element.

U.S. Patent Publication No 5226492 describes a packer for sealing an annular space comprising a deformable hollow metallic sleeve having an inner cavity which has an open end. The sleeve is preferably cone shaped. An expandable member is disposed within the inner cavity. A wedge member is located in close proximity to the expandable member, and serves to transmit a compressive force to the expandable member to obtain the desired radial expansion of the sleeve. The compression causes the expandable member to be forced around the outside of the wedge member and forms a first seal between the expandable member and an annular production casing. The rim of the metallic sleeve is also in contact with the production casing and accordingly a second seal is formed. Further, the metallic sleeve may comprise one or more slots at desired intervals to facilitate the deformation of the metallic sleeve. Additionally, a seal obtained using an additional band provides improved sealing due to an additional seal formed between the additional band and the inner wall of the production casing.

The main object of the third aspect of the invention is to provide a device which avoids the disadvantages of the prior art. The device according to the invention should be able to seal an annular tube, and also to join two tubes together, in a so-called swage process. Consequently, this requires considerable forces to be applied, which again demand packers with special properties.

SUMMARY OF THE INVENTION

According to a first aspect of the present invention, there is provided a method of securing a tubular member within a liner or borehole of a well, the method comprising:

inserting the tubular member into the borehole; and increasing the pressure within the tubular member between a pair of seal means associated with the tubular member, such that the pressure increase causes the tubular member to move radially outwardly to bear against the inner surface of the liner or borehole.

According to the first aspect of the present invention, there is also provided an apparatus for securing a tubular member within a liner or borehole, the apparatus comprising a seal means associated with the tubular member, and a pressure control means operable to increase the pressure within the tubular member, such that operation of the pressure control means causes the tubular member to move radially outwardly to bear against the inner surface of the liner or borehole wall.

Preferably, the pressure control means is also operable to monitor the pressure within the tubular member. Typically, the pressure control means is also operable to control the pressure within the tubular member.

Typically, the apparatus comprises a pair of seal means, and the pressure is preferably increased within the tubular member between the pair of seal means. The pressure may be provided by a hydraulic fluid or a gas.

The tubular member may be coupled to an apparatus for use within the borehole, such as a nipple profile, seal assy, seal bore receptacle, temporary liner/tubing section or other apparatus.

Typically, the method of the first aspect further comprises inserting the tubular member into the liner or borehole to the required depth. Conveyance of the apparatus may be by way of wireline, coil tubing or drill pipe.

The tubular member is typically in the form of a patch, and is preferably moved radially outwardly such that the tubular member undergoes elastic deformation and also plastic deformation. The tubular member is preferably formed from a suitable metal material, such as steel or an alloy material.

Typically, the apparatus further comprises a body located within the tubular member, and preferably located co-axially within the tubular member. Preferably, the pair of seal means are mounted upon the body and may be energised to seal against the inner surface of the tubular member. Typically, the body comprises a port to permit the flow of fluid into, and preferably to allow the flow of fluid out of, a chamber which is preferably defined by the outer surface of the body, inner surface of the tubular member, and inner faces of the pair of seal means. Preferably, the seal means are in the form of packer elements or segments, and which may be provided with back-up rings, which may be formed from steel. The body may contain hydraulic/electrical systems to control the flow of fluid, pressure and/or activate/de-activate the seals.

Typically, the pressure, flow volume, depth and diameter of the tubular at any given time will be monitored and recorded by either downhole instrumentation or surface instrumentation.

Preferably, the tubular member is releasably coupled to the body by means of a coupling means, which may comprise retractable pins or slips. The retractable pins or slips are preferably initially locked to the tubular member, and typically, after operation of the apparatus such that the tubular member has reached the desired level of expansion, the pins or slips are retracted inwardly toward the body, such that the engagement between the pins or slips and the tubular member is broken.

The tubular member is typically moved radially outwardly by the pressure to bear against the inner surface of the liner or borehole wall. Optionally, the liner may be provided with a surface that facilitates providing engagement between the liner and the tubular member, and the surface may comprise one or more recesses. This has the advantage of increasing the resistance to lateral movement occurring between the liner and the tubular member preventing the tubular member from being pushed down or pulled out of the liner or borehole.

Additional seal means may be utilised to provide a seal between the tubular member and the inside wall of the liner. The additional seal means may be provided by the (typically metal to metal) engagement between the inner surface of the liner and the outer surface of the tubular member to provide a hydraulic and/or gas seal therebetween. Alternatively, or in addition, further additional seal means may be provided, typically on the outer surface of the tubular member, to provide a hydraulic and/or gas seal between the tubular member and the liner. The further additional seal means may be formed from an elastomeric material and may be provided in the form of a band or a ring.

According to a second aspect of the present invention, there is provided a method of securing a first tubular member to a second tubular member already located within a liner or borehole of a well, the method comprising:

inserting the first tubular member into the borehole such that a lower end thereof is in close proximity with an upper end of the second tubular member; and increasing the pressure within one of the first and second tubular members between a pair of seal means associated with one of the first and second tubular members, such that the pressure increase causes one of the first and second tubular members to move radially to bear against a surface of the other of the first and second tubular members.

According to the second aspect of the present invention, there is also provided an apparatus for securing a first tubular member to a second tubular member already located within a liner of borehole of a well, the apparatus comprising:

a pair of seal means associated with one of the first and second tubular members;

and a pressure control means operable to increase the pressure within one of the first and second tubular members between the pair of seal means;

such that operation of the pressure control means causes one of the first and second tubular members to move radially to bear against a surface of the other of the first and second tubular members.

Preferably, the pressure control means is also operable to monitor the pressure within the tubular member. Typically, the pressure control means is also operable to control the pressure within said one of the first and second tubular members.

Typically, the pair of seal means are associated second tubular member, and preferably the pair of seal means are mounted on a body member. Preferably, the body member is lowered into the wellbore, typically through the first tubular member, by an elongate member such as a string of drill pipe, coiled tubing or wireline and is further lowered into the second tubular member. Preferably, the body member is lowered to the proximate to the upper end of the second tubular member until the body member is generally aligned with one or more profiles formed on a surface of the first tubular member. Typically, the profiles are formed on an internal surface of the first tubular member. Preferably, an overshot device is provided at or toward the lower end of the first tubular member and the one or more profiles are formed on an inner bore of the overshot device. Preferably, the pair of seal means are longitudinally spaced apart on the body member and the pair of seal means are typically arranged such that they are spaced further apart than the longitudinal extent of the one or more profiles. Typically, the body member is lowered into the first body member until the pair of seal means straddle the one or more profiles.

Preferably, the pair of seal means are actuated to seal against the inner bore of the second tubular member. Preferably, the body member is provided with one or more fluid ports or apertures typically in its sidewall. Preferably, a fluid, which may be a hydraulic fluid or a gas is used to provide the pressure and typically, the fluid is pumped through the first tubular member or if possible the elongate member, through the one or more fluid ports and into a chamber defined between the outer surface of the body member, the inner bore of the first tubular member and the pair of seal means. Typically, once the pressure has increased to a sufficient level, one or more portions, which are preferably circumferential portions, of the first tubular member are expanded or swaged into a respective number of the one or more profiles of the overshot device to form a joint between the first tubular member and the overshot device of the second tubular member. Accordingly, the one or more portions of the second tubular member are preferably moved radially outwardly such that the one or more portions undergo elastic deformation and also plastic deformation. The first tubular member is preferably formed from a suitable metal material, such as steel or an alloy material.

Typically, the method according to the second aspect of the present invention further comprises pulling the elongate member and the body member out of the well.

Preferably, the seal means are in the form of packer elements or segments, and which may be provided with support means.

Typically, the pressure, flow volume, depth and diameter of the tubular at any given time will be monitored and recorded by either downhole instrumentation or surface instrumentation.

According to a third aspect of the present invention there is provided a packer device for use in an annular space, where the packer device comprises at least one substantially cylindrical inner element, at least one seal assembly and a displacement means operable to apply a compression force on the seal assembly, where the inner element comprises a wedge member, and the seal assembly is slidable over the wedge member along the longitudinal direction of the at least one inner element, wherein the seal assembly expands radially outward when forced over the wedge member, the seal assembly comprising a radially expandable annular seal supported by radially expandable support sleeves, wherein the support sleeves comprise fingers supporting the annular seal, characterised in that the support sleeves comprise at least two types of fingers forming a substantially continuous support surface towards the annular seal in both expanded and non-expanded positions.

Preferably the packer device is for use in a production tube, casing tube, liner tube or the like. Typically, the displacement means is disposed between the inner element and the seal assembly. Preferably, the fingers are connected to an end of their respective support sleeve.

Typically, the first type of finger comprises a generally triangular support member, the end surface of which defines a support surface and the second type of finger preferably comprises a generally triangular support member being generally T-shaped seen from above, the end of which defines a support surface, where the other side of the support member defines a support surface. More preferably, every second finger of the support sleeve is of the first type of finger, or the second type of finger respectively.

Preferably, the support surfaces of the second type of fingers in a running in hole position rest on the support surfaces of the first type of fingers. Typically, the support surfaces of the second type of fingers in a running in hole position are resting on at least some of the support surfaces of the first type of fingers.

Typically there are at least two packer devices connected by means of a mandrel. Preferably, an annular sleeve is disposed between the at least two packer devices and the production tube, said annular sleeve being disposed in a longitudinal direction between two seal assemblies, wherein the annular sleeve preferably provides a sealing surface towards the production tube.

Alternatively, an isolation plug is provided which comprises one packer device which could be run on drill pipe, coil tubing or wireline. Setting of the plug may be by hydraulic or mechanical means. Typically, a seal setting piston is attached to a mandrel which protrudes through an upper end of the single packer device of the plug. Preferably, the mandrel is attached to a setting tool, such that when the mandrel is pulled upwards against a sleeve mounted against the upper end of the single packer device, the annular seal is activated and is extruded outwardly to contact the casing wall, for instance. Final setting loads of the plug may be set via either a mechanical shear means when set mechanically or via the final hydraulic pressure when set with hydraulic means. The seal setting piston would be maintained in the set position via locking the hydraulics in place for a hydraulic set or with slips or a ratchet mechanism for mechanical sets.

For retrieval of the plug, the annular seal would be de-activated via releasing the hydraulic pressure or by releasing the ratchet/slip mechanism.

For high differential pressures, the setting force would be sufficiently high to swage the casing with the single seal assembly, thereby key seating the seal assembly into the well delivering a large resistance to movement up or down the well.

According to a fourth aspect of the present invention there is provided an isolation plug for plugging a downhole tubular, the isolation plug comprising a seal means and a seal actuation mechanism, the seal actuation mechanism being operable to expand the seal means in a radially outwards direction toward the downhole tubular to seal against an inner bore thereof.

According to a fourth aspect of the present invention there is provided a method of plugging a downhole tubular comprising inserting an isolation plug into the downhole tubular to a desired location and expanding a seal means of the isolation plug in a radially outwards direction toward the downhole tubular by operating a seal actuation mechanism of the isolation plug such that the seal means seals against an inner bore of the downhole tubular.

The seal actuation mechanism may comprise a hydraulic or mechanical means but preferably comprises a hydraulic means. The isolation plug may be run into the downhole tubular on drill pipe, coil tubing or wireline. Typically, a seal setting piston is attached to a mandrel which protrudes through an upper end of the isolation plug. Preferably, the mandrel is attached to a setting tool, such that when the mandrel is pulled upwards against a sleeve mounted against the upper end of the isolation plug, the seal means is activated and is extruded outwardly to contact the downhole tubular. Final setting loads of the isolation plug may be set via either a mechanical shear means when set mechanically or via the final hydraulic pressure when set with hydraulic means. The seal setting piston would be maintained in the set position via locking the hydraulic fluid pressure in place for a hydraulic set or with slips or a ratchet mechanism for mechanical sets.

For retrieval of the isolation plug, the seal means is de-activated via releasing the hydraulic pressure or by releasing the ratchet/slip mechanism.

For high differential pressures, the setting force may be sufficiently high to swage the downhole tubular with the isolation plug, thereby key seating the seal means and thus the isolation plug into the well delivering a large resistance to movement up or down the well.

BRIEF DESCRIPTION OF THE DRAWINGS

Embodiments of the three aspects of the present invention will now be described, by way of example only, with reference to the accompanying drawings, in which:

FIG. 33 shows fingers of the support ring in detail, where

DESCRIPTION OF PREFERRED EMBODIMENTS

Figure 1:
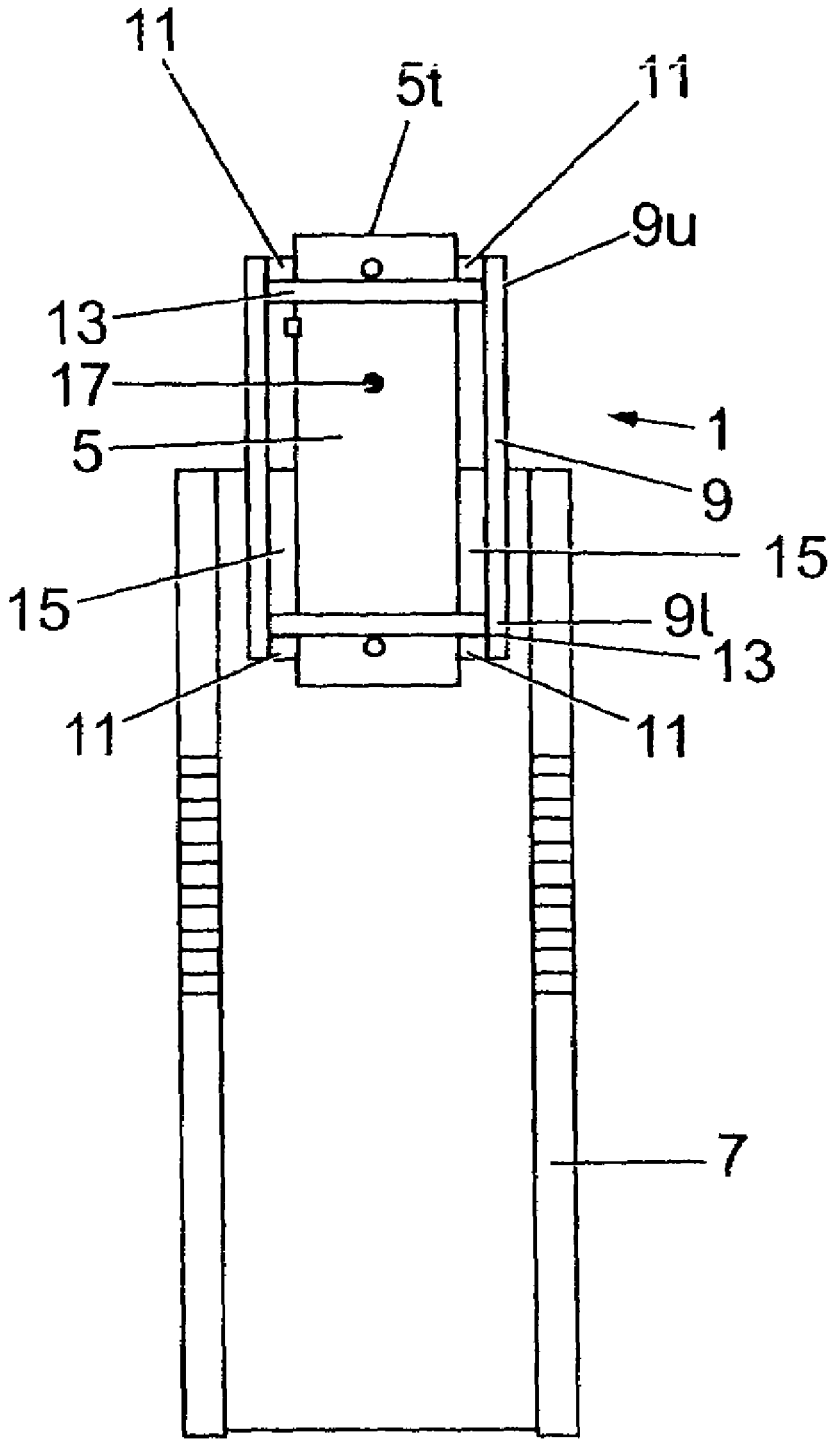
FIG. 1 is a schematic representation of an apparatus, in accordance with a first aspect of the present invention, being conveyed through a liner on wireline, drill pipe or coiled tubing toward a location at which it will be operated.

FIG. 1 shows an apparatus in accordance with the present invention, and which can be used to provide a method in accordance with the first aspect of the present invention. The apparatus is generally designated at 1.

Figure 17:
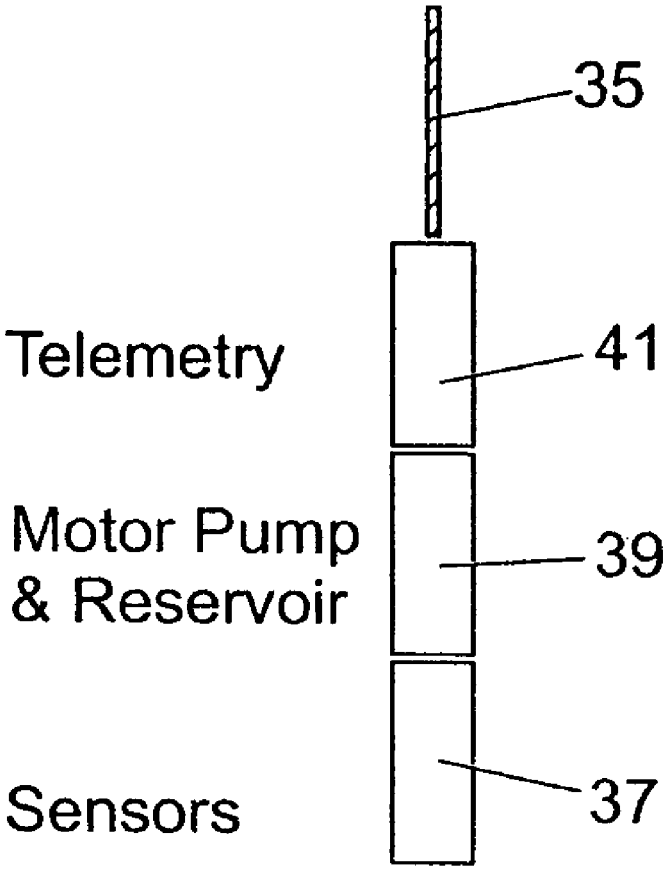
FIG. 17 is a first example of a method of conveyance for an apparatus in accordance with the first aspect of the present invention, utilising wireline and possibly containing downhole telemetry for control of the pressure and flow sensors and logic control of the hydraulics, and this equipment may also contain a fluid reservoir which feeds the pump and generates the pressure.

The apparatus 1 comprises a body 5 which is run into a casing, liner or tubing 7 or a borehole (not shown) by means of wireline (not shown in FIG. 1 but see FIG. 17), coiled tubing (not shown) or drill pipe (not shown in FIG. 1 but see FIG. 18), or some other suitable conveyance means, and which is attached to the body 5 at the upper end 5t thereof.

The body 5 is generally tubular in shape, and preferably comprises hydraulic logic to control the setting sequence.

A patch or tubular member 9 (hereinafter referred to as tubular member 9) is shown in FIG. 1. The tubular member 9 is a cylinder, and is arranged co-axially about the body 5. The tubular member 9 is secured, at its upper 9U and lower 9L ends, to the body 5 by any suitable means, such as hydraulically actuated centralising pins 11. The apparatus 1 also comprises a pair of seal members 13, which are in the form of packer elements 13, and which are typically arranged axially inwards of the pins 11 and steel back up segments that prevent extrusion of the seal packer elements 13. In this manner, the apparatus 1 comprises a chamber 15 which is defined in volume by the inner surfaces of the packer elements 13, the inner circumference of the tubular member 9, and the outer surface of the body 5. The chamber 15, as shown in FIG. 1, is sealed by the packer elements 13 with respect to the environment outside of the chamber 15.

A port 17 is formed in the side wall of the body 5, such that the inner bore of the body 5 is in fluid communication with the chamber 15. The body 5 also constrains the opposing hydraulic forces between the seals 13 when pressure is applied in the chamber 15.

In one embodiment of the invention, the apparatus 1 can be run into a liner or borehole on coiled tubing or drill pipe and in this case, the port 17 is in fluid communication with the interior of the coiled tubing or drill pipe respectively.

However, in another embodiment of the invention, the apparatus 1 can be run into the liner or borehole on wireline, and in this embodiment, the port 17 is in fluid communication with a motor pump and fluid reservoir tool which is also run into the liner or borehole with the apparatus, details of which will be described subsequently.

A method in accordance with the present invention will now be described.

Figure 2:
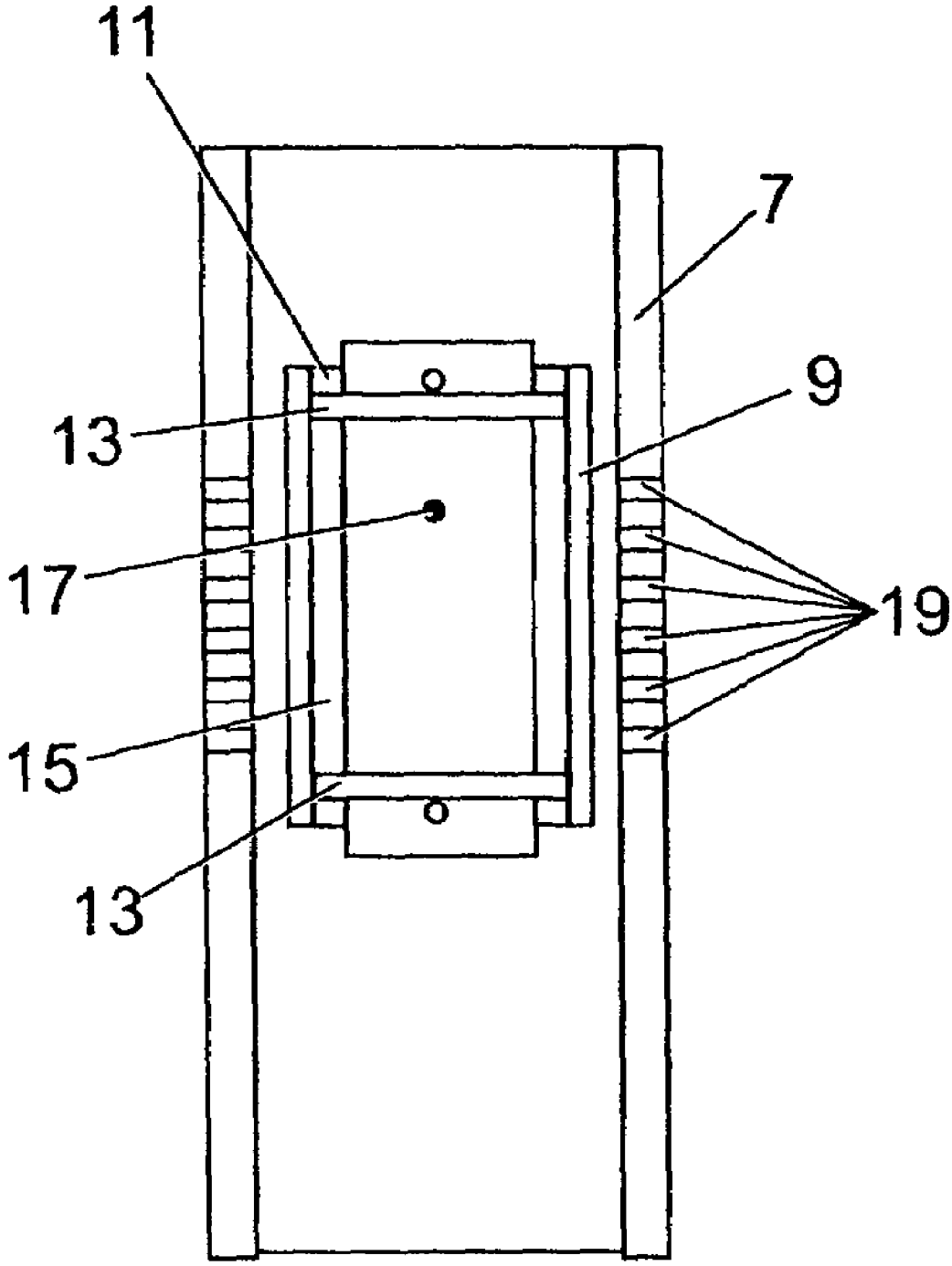
FIG. 2 is a schematic representation of the apparatus of FIG. 1 adjacent to the location in the liner at which it will be operated.
Figure 4:
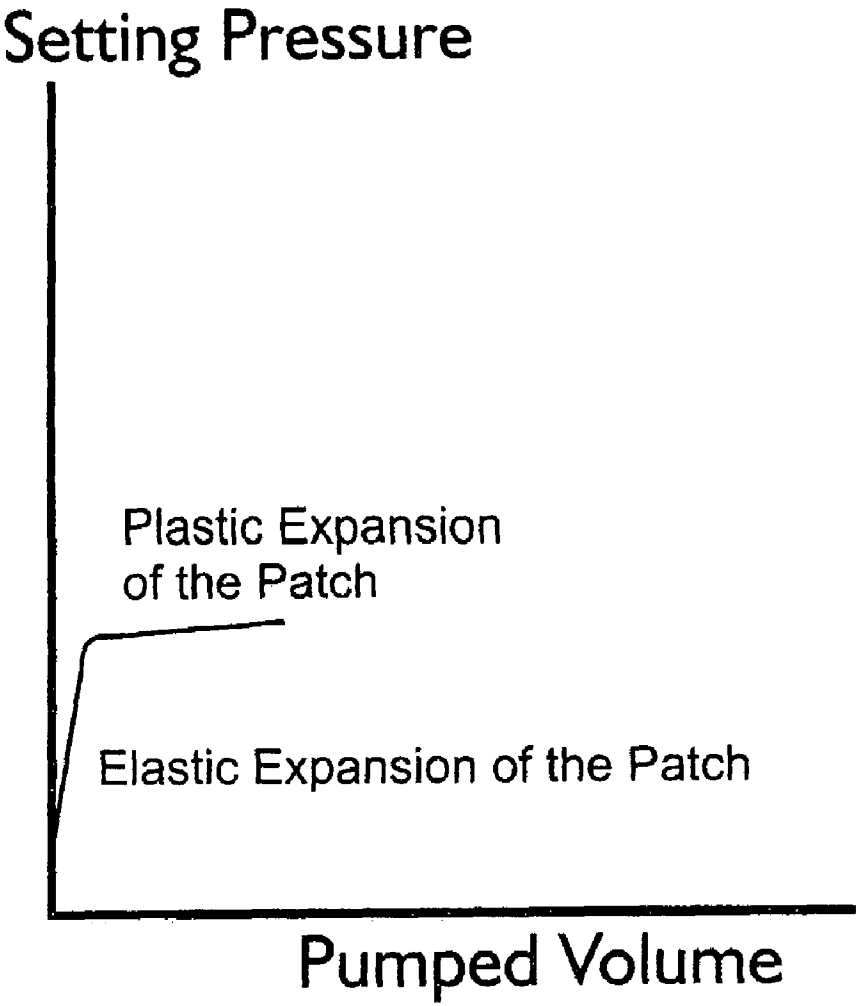
FIG. 4 is a graph of pumped volume on the X-axis versus setting pressure on the Y-axis indicating the expansion of a tubular member shown in FIG. 3.
Figure 3:
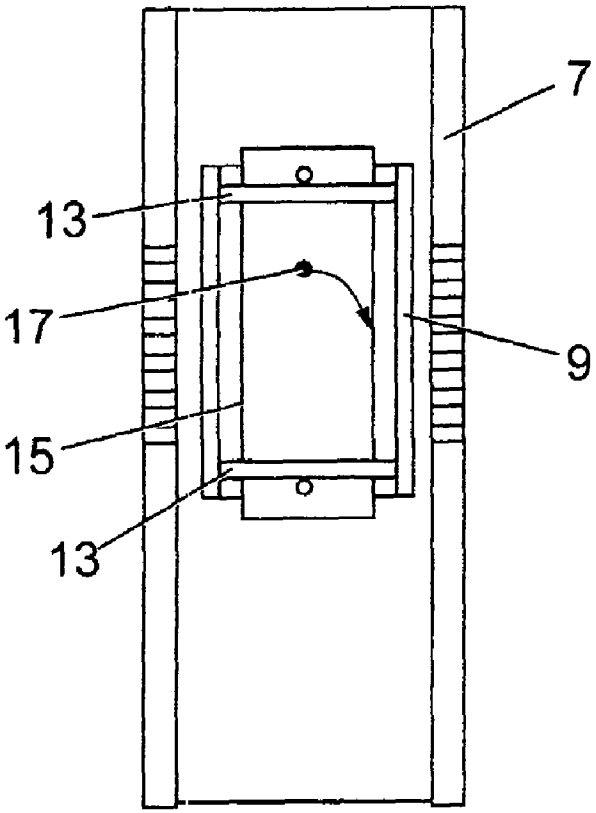
FIG. 3 is a schematic representation of the apparatus of FIG. 1 during its operation.
Figure 6:
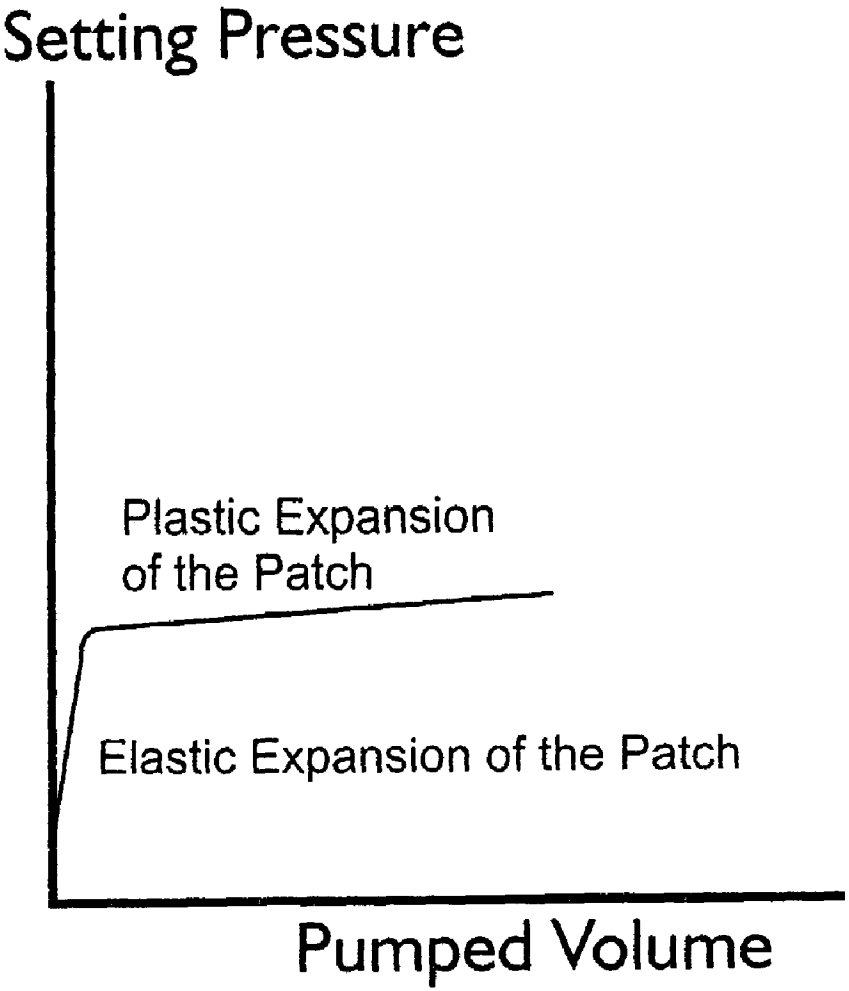
FIG. 6 is a table of pumped volume versus setting pressure indicating the expansion of the tubular member shown in FIG. 5, the tubular member now having passed the elastic limit and going through permanent plastic deformation.
Figure 5:
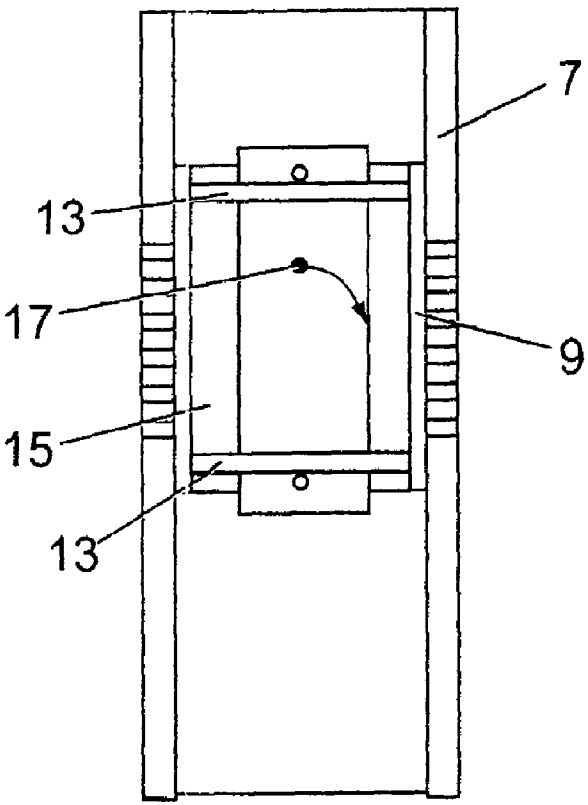
FIG. 5 is a schematic representation of the apparatus of FIG. 1 during continued operation.

The apparatus 1 is conveyed into the liner or borehole by any suitable means, such as wireline, coiled tubing or drill pipe until it reaches the location within the liner or borehole at which operation of the apparatus is intended. This location is shown in FIG. 2 as being a location within the liner 7 or borehole at which there is either damage to the liner 7, shown at 19, or where apertures 19 in the liner 7 require to be obturated. At this point, isolation seals are actuated from surface (in the situation where drill pipe or coiled tubing is being used) to allow hydraulic fluid to be pumped under pressure down the bore of the coiled tubing or drill pipe, such that the hydraulic fluid flows through the port 17 into the chamber 15. In the case where wireline is being used to convey the apparatus 1 into the borehole, the pump motor is operated to pump hydraulic fluid from the fluid reservoir into the chamber 15 through the port 17. This causes the packer elements 13 to move outwardly to seal against the inner circumference of the ends 9U, 9L of the tubular member 9. Hence, a high pressure seal is formed between the packer elements 13 and the tubular member 9. The pressure between the packer element seals 13, and hence within the chamber 15, continues to increase, such that the tubular member 9 initially experiences elastic expansion, and then plastic expansion, in an outwards direction which is shown in FIG. 3 and in the graph of FIG. 4. The tubular member 9 expands beyond its yield point, undergoing plastic deformation and this is shown in the graph of FIG. 6, until the tubular member 9 forces against the inner surface of the liner 7, as shown in FIG. 5. The packer elements 13, and associated steel back-up rings (not shown) also continue to move outwardly, such that the chamber 15 is sealed. If desired, the pressure of fluid within the chamber 15 can be bled off at this point.

Figure 8:
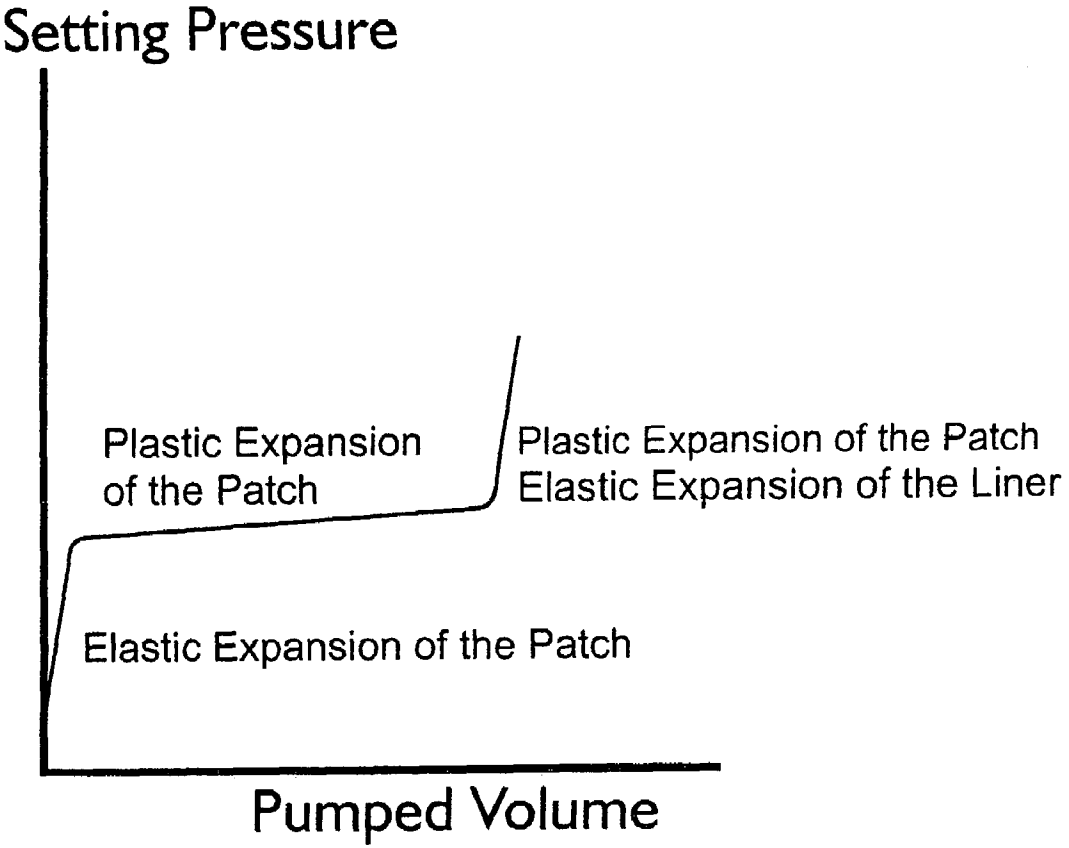
FIG. 8 is a table of pumped volume versus setting pressure for the representation shown in FIG. 7.
Figure 7:
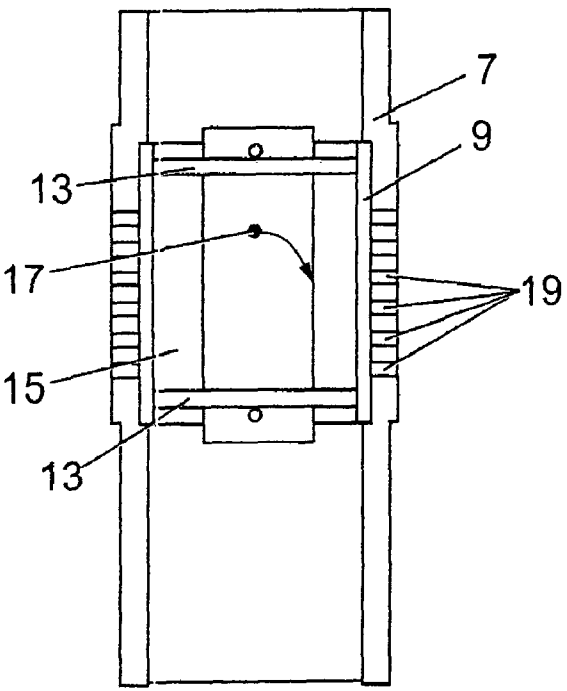
FIG. 7 is a schematic representation of the apparatus of FIG. 1 after continued operation, with the tubular member making contact with the liner wall.
Figure 9:
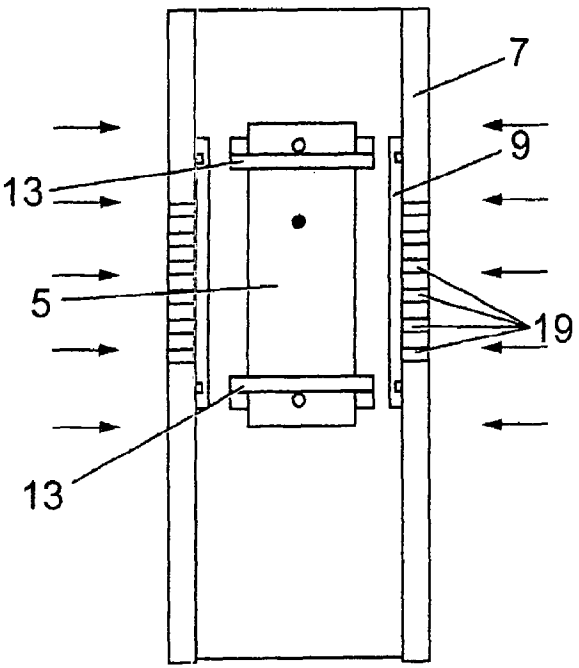
FIG. 9 is a schematic representation of the apparatus of FIG. 1 after continued operation.

Alternatively, the increase of pressure within chamber 15 can be maintained, such that the tubular member 9 continues to move outwardly against the liner 7, such that the liner 7 starts to experience elastic expansion, and this situation is shown in FIG. 7 and in the graph of FIG. 8. As will be understood, as the tubular member 9 makes contact with the liner wall 7, the pressure increases due to the resistance of the liner wall 7 until the liner wall 7 undergoes elastic deformation, typically in the region of a few percent. The pressure can be increased up to the desired level, which may be many thousand psi. The increase in the pump volume and setting pressure of fluid can be continued until a desired level of plastic expansion of the tubular member 9 has occurred, and with the liner 7 having only undergone elastic expansion, when the pressure of the fluid is reduced, the liner 7 will maintain a compressive force inwardly upon the plastically expanded tubular member 9, and this situation is shown in FIG. 9 and in the graph shown in FIG. 10. Hence, with the liner 7 having undergone typically a few percent elastic deformation, the pressure is released on the seals (in the form of the packer elements 13, and associated steel back-up rings) and the locating pins 11 will automatically withdraw. The tubular member 9 is securely held since it has undergone plastic deformation and the liner 7 remaining in, typically a few percent, elastic deformation.

Figure 10:
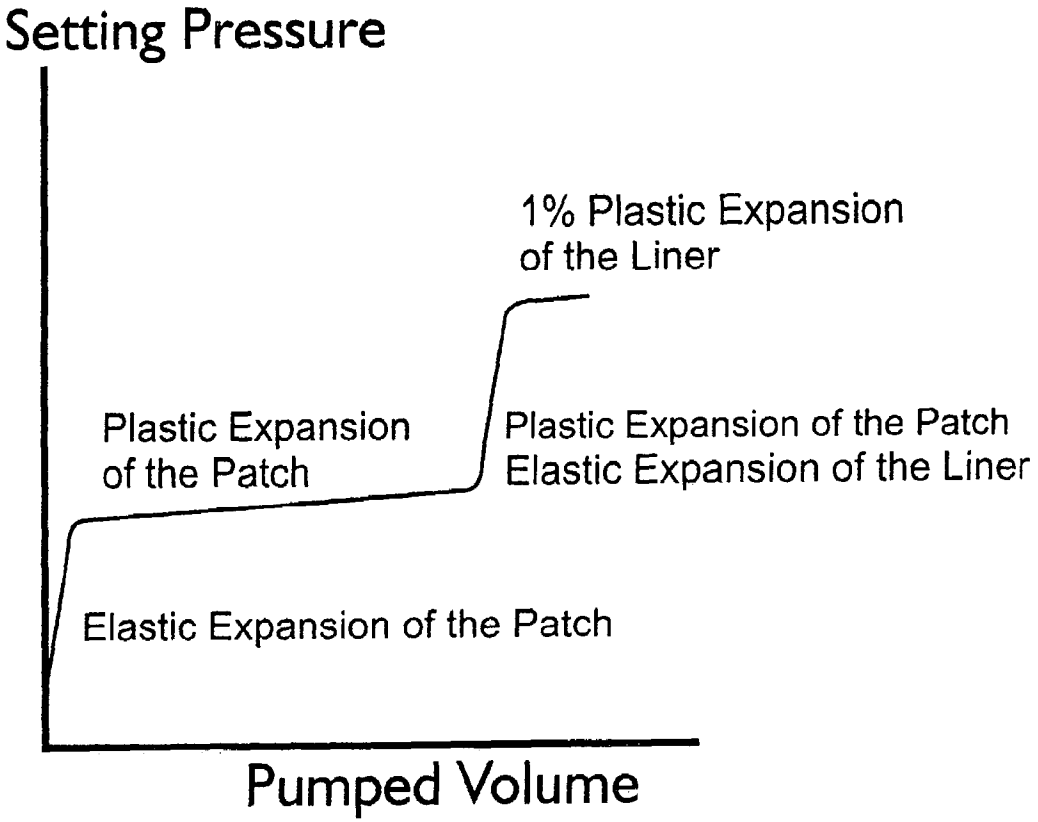
FIG. 10 is a graph of the pumped volume versus setting pressure for the representation shown in FIG. 9.

The upper right corner of the graph of FIG. 10 shows the tubular member 9 and liner 7 have both undergone plastic deformation following a further increase in the pump volume and setting pressure of the fluid, with the liner 7 undergoing 1% plastic deformation.

Hydraulic logic and associated valves and switching arrangements are provided within the pressure system located within the body 5, and the logic is arranged such that when the pressure is released, the pins 11 are released.

Figure 11:
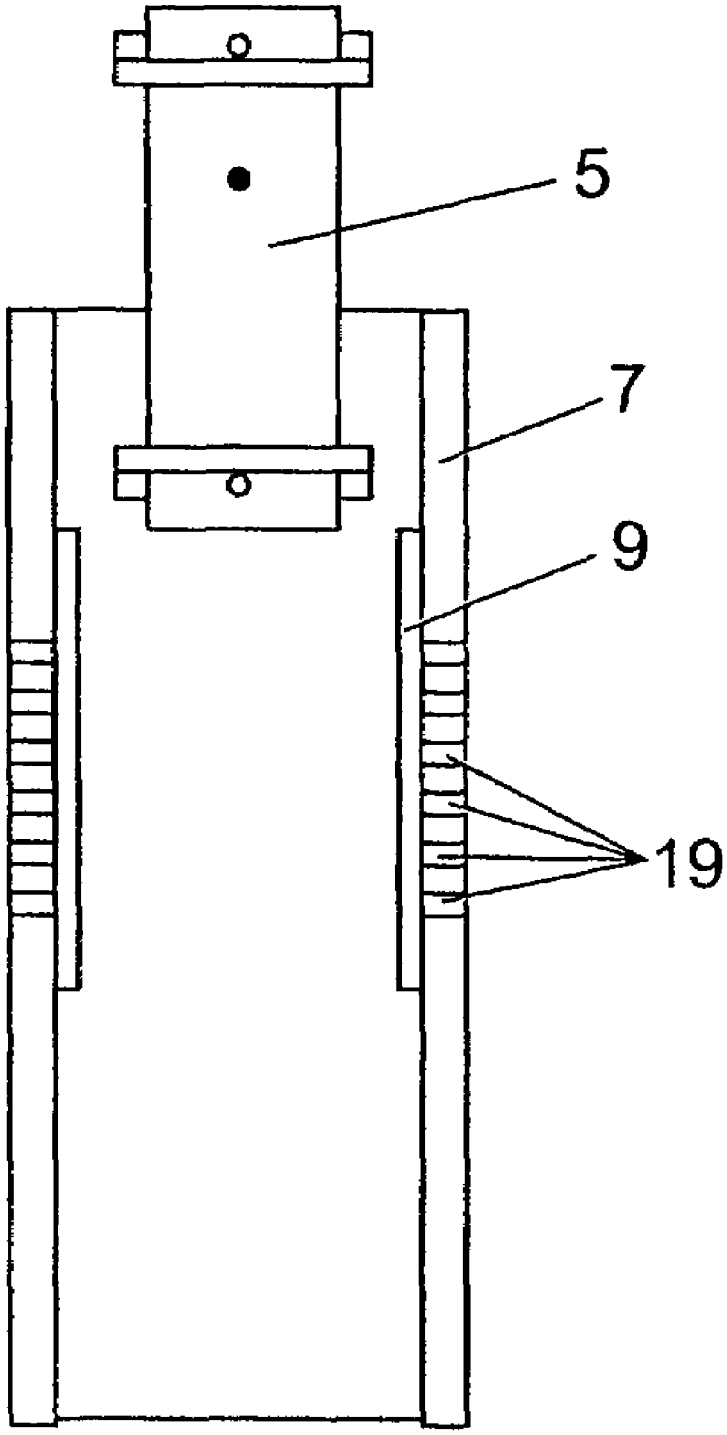
FIG. 11 is a schematic representation of the apparatus of FIG. 1 following continued operation.

The releasing of the pressure of the fluid causes the hydraulically actuated centralising pins 11 to retract radially inward into the body 5, and this also causes the packer elements 13 to retract radially inward toward the body 5, such that the seal between the body 5 and tubular member 9 is released, and the body 5 is free from engagement with the tubular member 9. The body 5 can then be withdrawn upwards from the borehole, and as shown in FIG. 11, the tubular member is held in compression by the force of the elastic compression of the tubing 7 across the full length and circumference of the tubular member 9.

The arrangement of double packer elements 13 is most suitable for relatively short length of tubular members 9 in the region of up to a few meters in length. This relatively short length tubular member 9 is suitable for use in water shut-off across perforations or tubing leaks, and repairing damaged casing or liner tubing 7.

Figure 12:
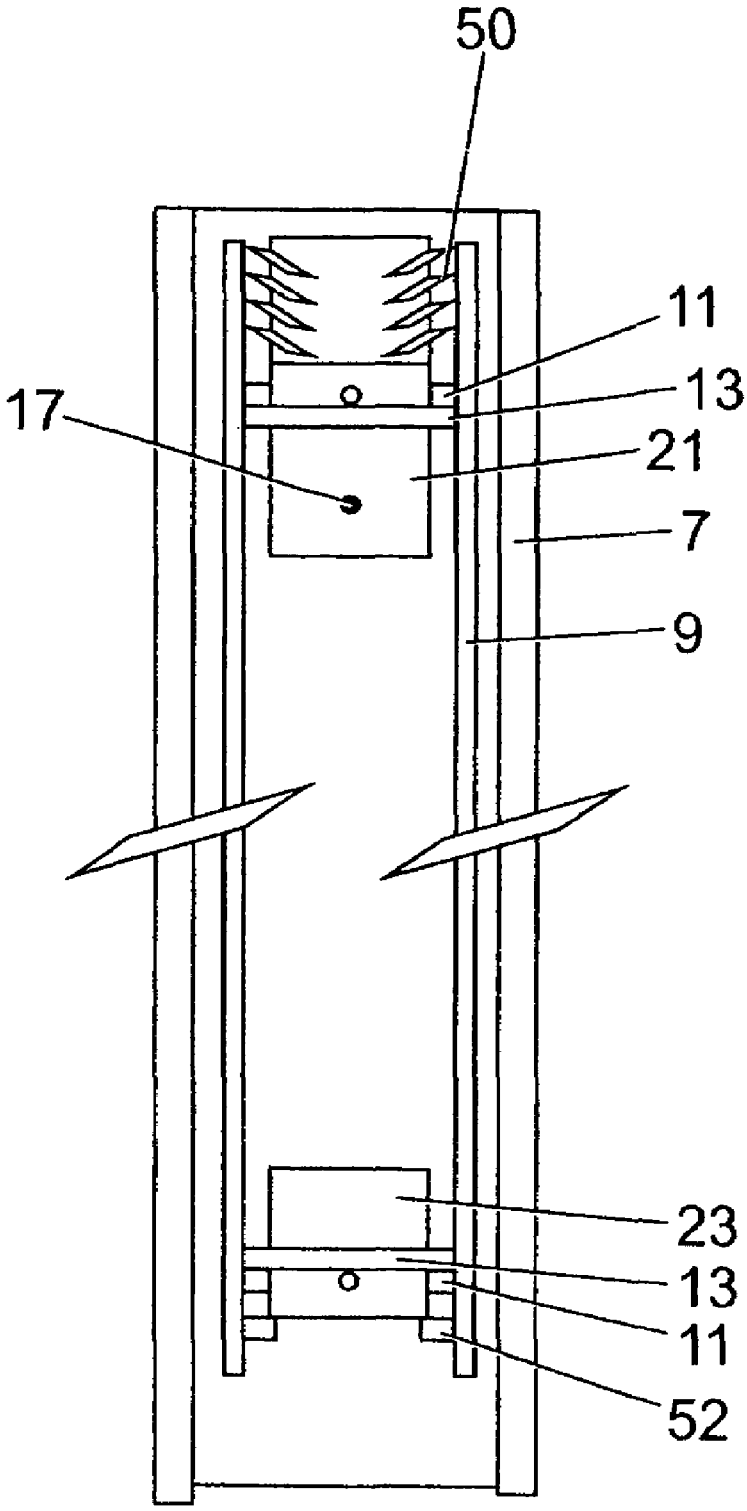
FIG. 12 is a second embodiment of an apparatus in accordance with the first aspect of the present invention, showing a variable length extrudable liner/casing patch.

An alternative embodiment of the invention is shown in FIG. 12 and provides a variable length extrudable tubular member 9. As shown in FIG. 12, the tubular member 9 is of any suitable length. The embodiment of FIG. 12 comprises an upper body section 21, and a lower body section 23, both of which comprise hydraulically actuated centraliser pins 11 and sealing members 13 in the form of packer elements 13, as with the first embodiment of the apparatus 1. The port 17 is carried on the upper body section 21, and the second embodiment is operated in a similar manner to the first embodiment 1. However, slips 50 are provided on the upper body section 21, and act between the upper body section 21 and the inner surface of the upper end of the extrudable tubular member 9 in order to ensure that there is no unwanted slippage therebetween when the pressure within the chamber 15 increases. Internal dogs, inwardly projecting keys, or another suitable arrangement (generally designated at 52) are provided on the inner surface of the lower in use end of the tubular member 9 and which act to stop the lower body section 23 from bursting out of the lower end of the lower body section 23 when the pressure within the chamber 15 increases. The lower body section 23 can be retrieved from the interior of the tubular member 9 after the tubular member 9 has been expanded, for instance by a fishing operation, or the lower body section 23 can be pumped out of the lower end of the tubular member 9.

Figure 13:
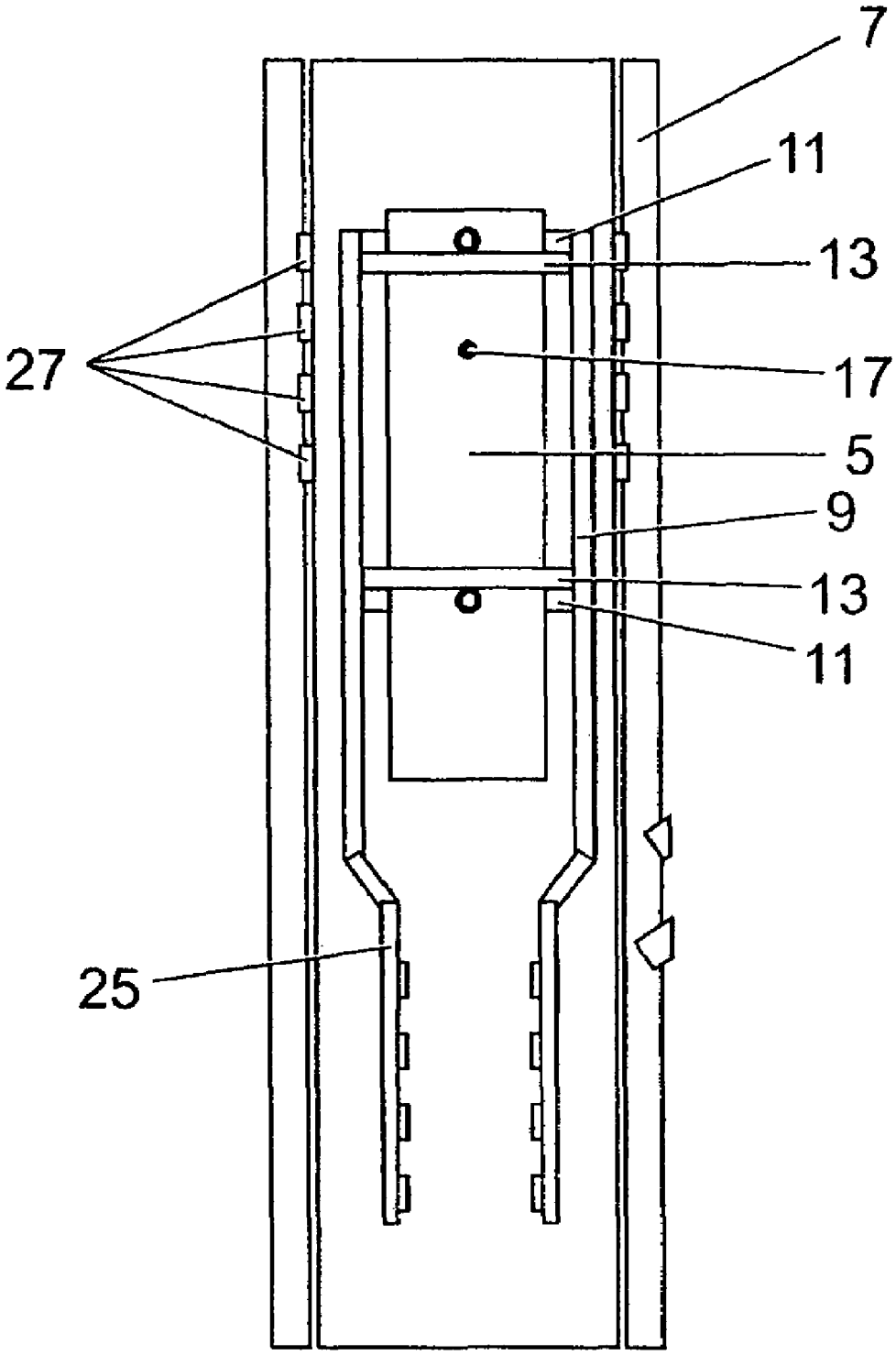
FIG. 13 is a third embodiment of an apparatus in accordance with the first aspect of the present invention, incorporating a tubing receptacle and seal assembly (also known as a seal assy) and due to the heavy loading applied to the seal assy, the liner is shown with a recess profile into which the tubular member will be plastically deformed.
Figures 14A, 14B:
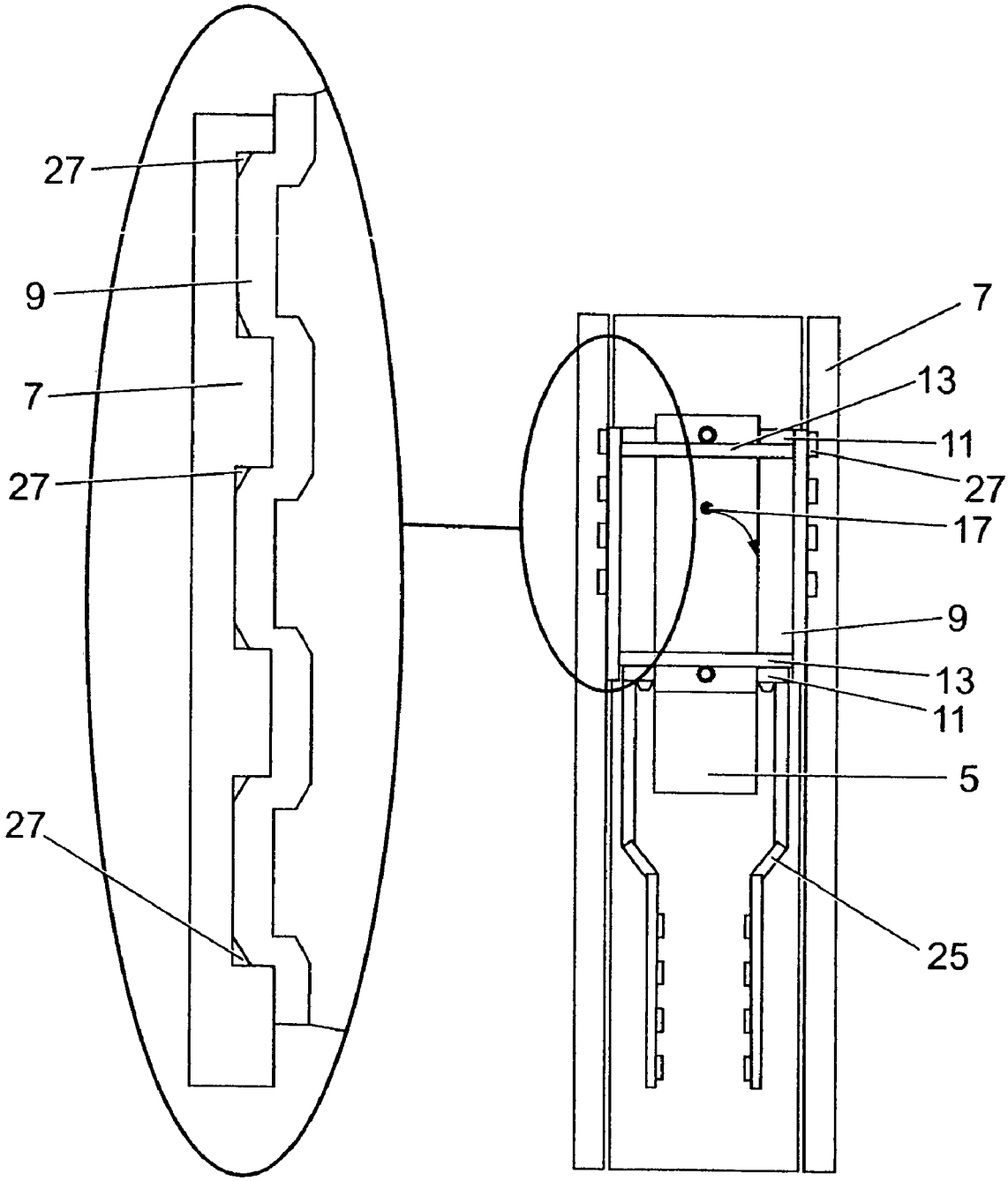
FIG. 14*a* is a schematic representation of the seal assy of FIG. 13, after the apparatus has been operated, showing the plastic deformation of the tubular member into the recess in the liner wall.
FIG. 14*b* is a detailed schematic representation of a portion of the representation of FIG. 14*a* showing the plastic deformation of the tubular member into the recess in the liner wall.

A third embodiment of an apparatus in accordance with the present invention is shown in FIG. 13 as comprising a body 5 with upper and lower packer elements 13 and upper and lower sets of hydraulically actuated centralising pins 11. The body also carries a port 17 located between the two packer elements 13 and is operated in a similar manner to the apparatus 1. However, the tubular member 9 is integrally formed with a seal assy 25 at its lower end, which can be used as a tubing receptacle and seal assembly. It should be noted in FIG. 13 that the liner 7 has been pre-formed with a bank of recesses 27 which are axially spaced along a short length of the interior surface of the liner 7. In the examples shown in FIG. 13, there are four recesses 27, but any suitable number of recesses 27 can be performed. As seen most clearly in FIG. 14*b*, the tubular member 9 will expand into the recesses 27, and the engagement there between will provide the tubular member 9 with a much higher resistance to lateral movement through the liner. In the example given in FIG. 14*a*, the tubular member 9 is used to set the tubing receptacle and seal assembly (also known as a seal bore receptacle) within the liner 7.

Figures 15A, 15B:
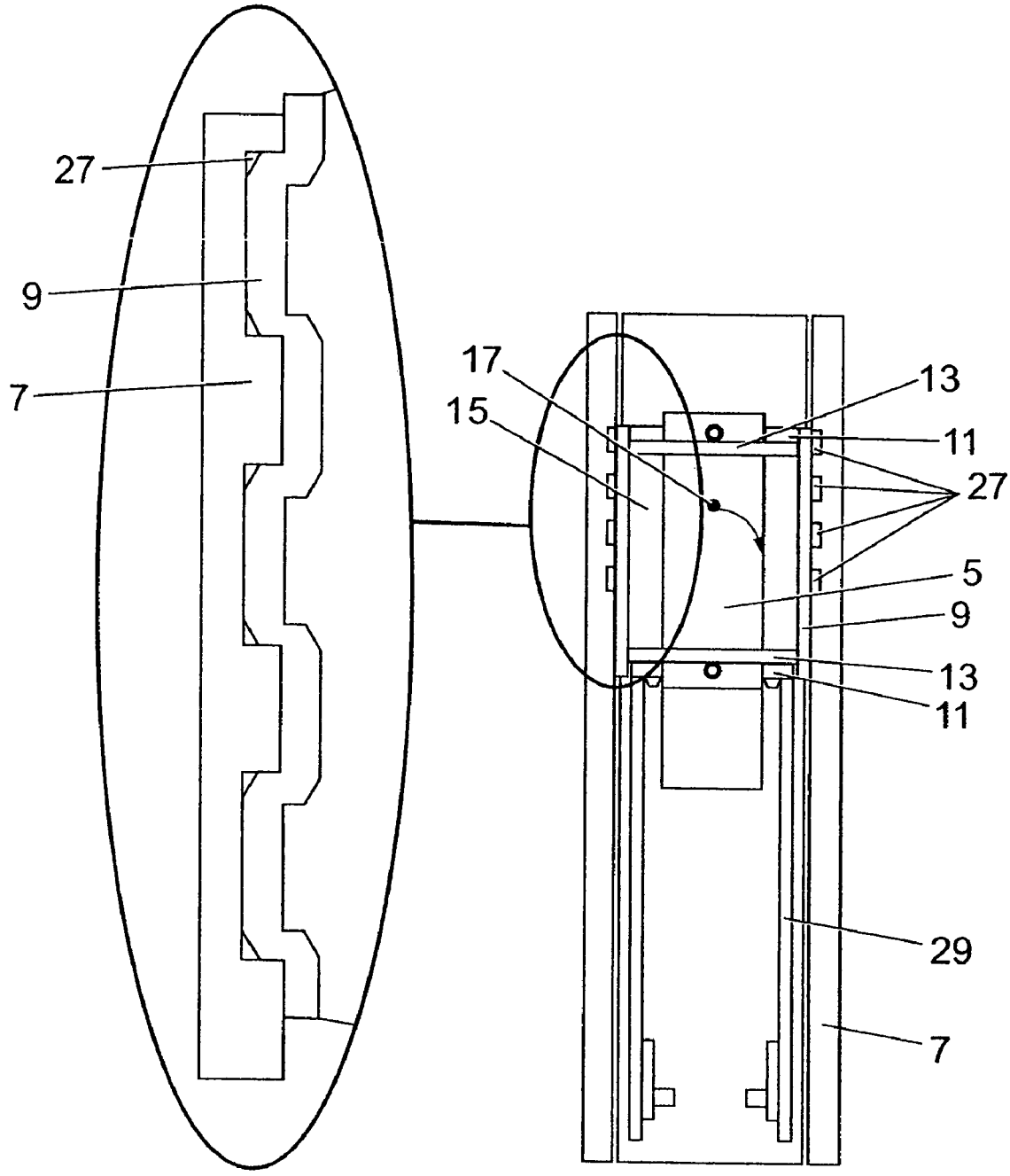
FIG. 15*a* is a schematic representation of a fourth embodiment of an apparatus in accordance with the first aspect of the present invention, incorporating a nipple profile to be set in a liner.
FIG. 15*b* is a detailed schematic representation of a portion of the apparatus of FIG. 15*a* again showing the plastic deformation of the tubular member into the recess in the liner wall which will withstand severe lateral loading.

As shown in FIGS. 15*a* and 15*b*, the lower end of the tubular member 9 is secured to a nipple profile 29, and hence can be used to set the nipple profile 29 within the liner 7.

Figures 16A, 16B:
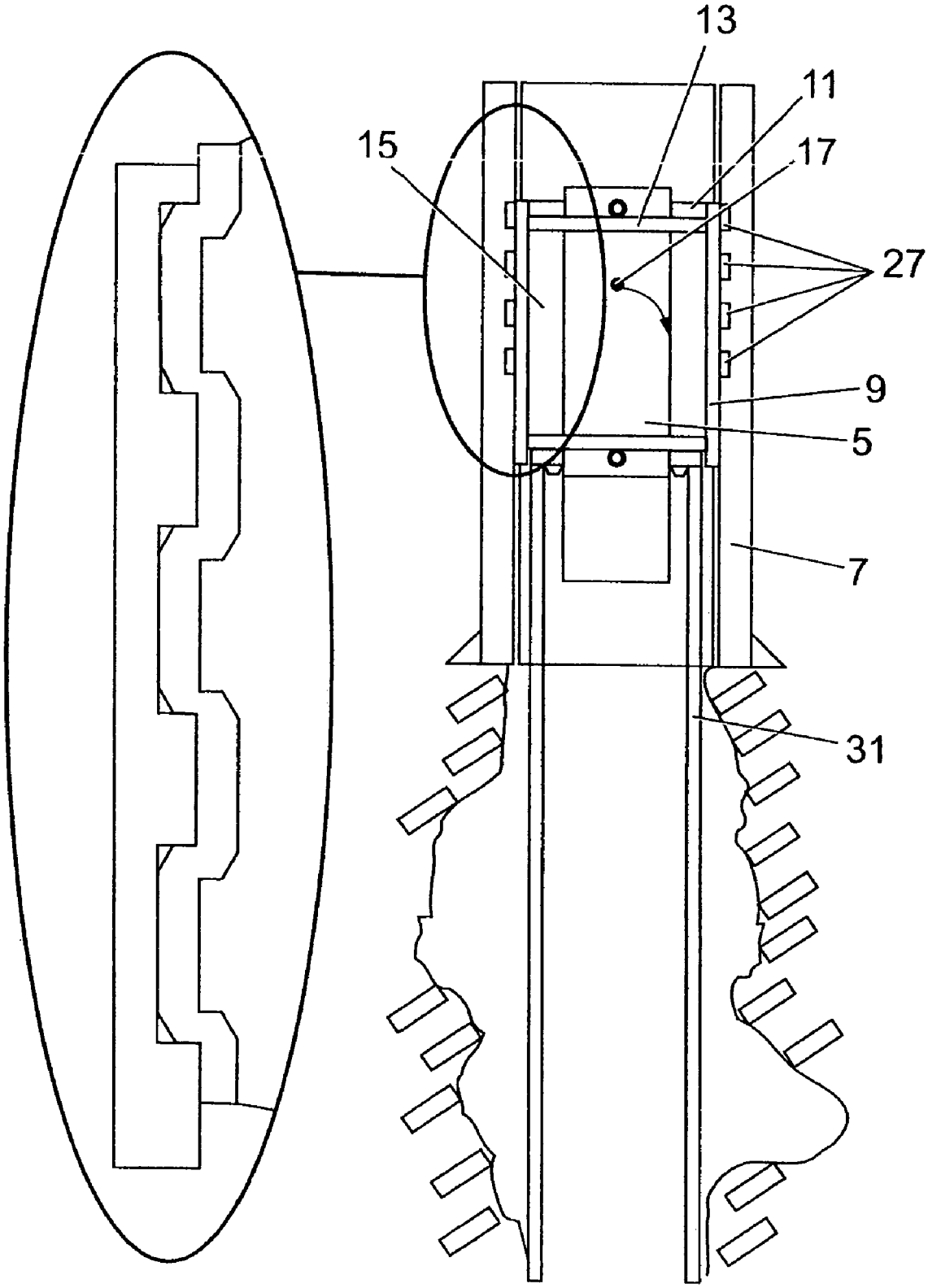
FIG. 16*a* is a schematic representation of a fifth embodiment of an apparatus in accordance with the first aspect of the present invention, incorporating a tubular member with an extension of a temporary liner to be set across a washed-out section of a borehole below a casing shoe.
FIG. 16*b* is a detailed schematic representation of a portion of the representation of FIG. 16*a* again showing the plastic deformation of the tubular member into the recess in the liner wall.

A further alternative embodiment of the invention is shown in FIG. 16*a*, and FIG. 16*b*, where the lower end of the tubular member 9 is secured to a temporary liner section 31. In this example, the temporary liner section 31 is set across a washed-out section below the casing shoe at the very end of the liner 7.

Figure 18:
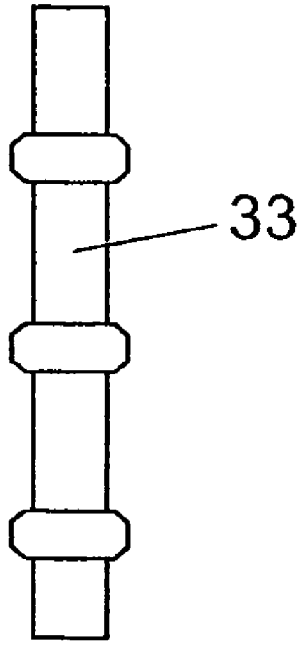
FIG. 18 is a second example of a method of conveyance for an apparatus in accordance with the first aspect of the present invention, utilising drill pipe or coil tubing, and in this example, the pressure and flow may be applied and monitored from surface of the borehole.

As previously described, the apparatus 1 can be conveyed into the borehole by means of drill pipe 33 or coiled tubing with pressure controlled from the surface, and in this example, the drill pipe 33 is shown in FIG. 18.

Alternatively, the apparatus 1 can be conveyed into the borehole by means of wireline 35, and in this example, the apparatus 1 is coupled to the lower end of a sensor tool 37 which can be used to indicate the pressure of fluid being pumped into and through the port 17. The upper end of the sensor tool 37 is coupled to the lower end of a motor pump and hydraulic fluid reservoir 39, the upper end of which is coupled to the lower end of telemetry tool 41 which can be used to indicate the position of this bottom hole assembly to the operator at the surface.

Figure 19:
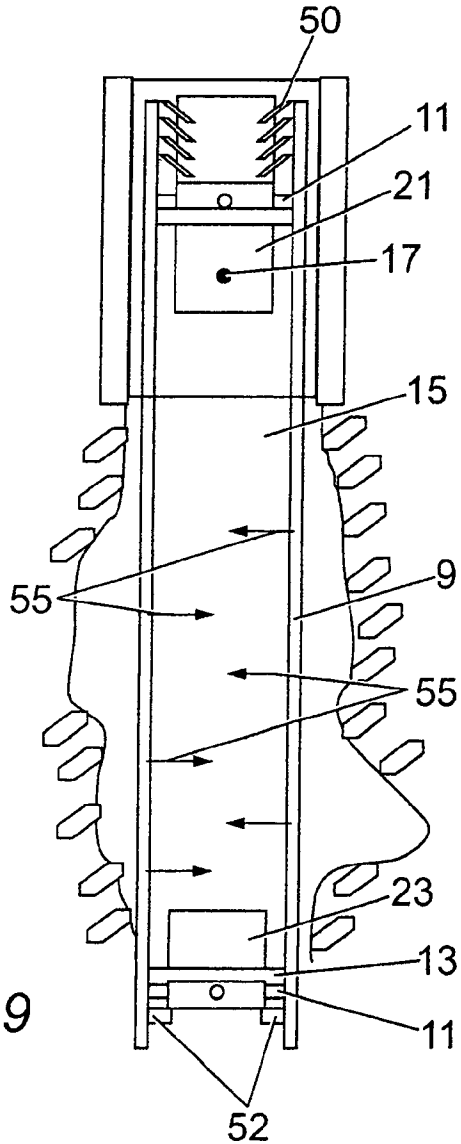
FIG. 19 is a schematic representation of a sixth embodiment of an apparatus in accordance with the first aspect of the present invention, incorporating a liner section constructed from a malleable material which is capable of a high degree of plastic expansion.
Figure 20:
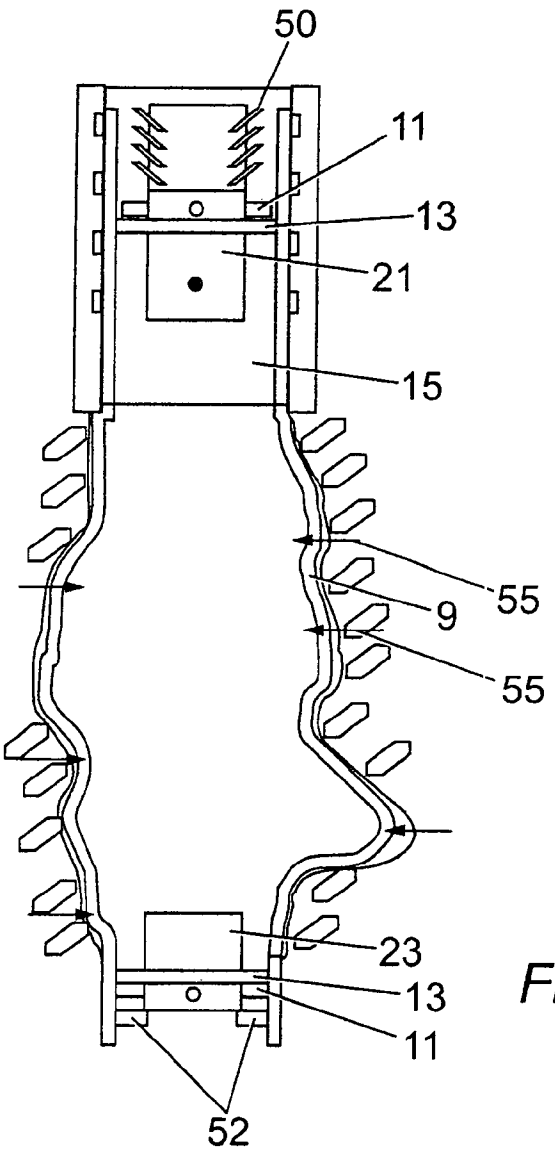
FIG. 20 is a schematic representation of the embodiment of FIG. 19, wherein the liner has been expanded and forms a barrier, akin to a mud cake, within an open hole section of the borehole, and which is possibly pinned in place.

FIG. 19 shows a further embodiment of an apparatus in accordance with the present invention. This embodiment of the invention provides a variable, and in this example, extended length liner in the form of an extrudable tubular member 9. As shown in FIG. 19, the tubular member 9 is of any suitable length. The embodiment of FIG. 19 comprises an upper body section 21, and a lower body section 23, both of which comprise hydraulically actuated centraliser pins 11 and sealing members 13 in the form of packer elements 13, as with the first embodiment of the apparatus 1. The port 17 is carried on the upper body section 21, and the embodiment of FIG. 19 is operated in a similar manner to the first embodiment 1. However, slips 50 are provided on the upper body section 21, and act between the upper body section 21 and the inner surface of the upper end of the extrudable tubular member 9 in order to ensure that there is no unwanted slippage therebetween when the pressure within the chamber 15 increases. Internal dogs, inwardly projecting keys, or another suitable arrangement (generally designated at 52) are provided on the inner surface of the lower in use end of the tubular member 9 and which act to stop the lower body section 23 from bursting out of the lower end of the lower body section 23 when the pressure within the chamber 15 increases. The lower body section 23 can be retrieved from the interior of the tubular member 9 after the tubular member 9 has been expanded, for instance by a fishing operation, or the lower body section 23 can be pumped out of the lower end of the tubular member 9. The pressure within the chamber 15 is increased as before, such that the tubular member 9 expands to meet the inner surface of the open hole section of the borehole, which may be a greater diameter than the drill bit diameter, as shown in FIG. 20. Pins 55 may optionally be provided as shown in FIGS. 19 and 20, through the side wall of the tubular member 9 (with a suitable sealing arrangement therebetween), such that the pins are forced into the formation to enhance the grip between the formation and the tubular member 9. The pins 55 (if present) are preferably run into the borehole, such that they are projecting inwardly from the tubular member, so that no obstruction is provided by the pins 55, on the outer surface of the tubular member 9, when the apparatus is being run into the borehole. The tubular member 9 of FIGS. 19 and 20 is preferably formed from a relatively highly malleable, and thus relatively highly extrudable, metal, such that it can undergo a relatively large degree of plastic deformation without rupturing. Additionally during the setting sequence of the tubular member 9, the hydrostatic pressure within the borehole, which to a large extent is created by the amount of fluids which have been introduced into the borehole from surface, may be reduced (by withdrawn a volume of these fluids from the borehole) so that when the tubular member 9 is expanded and the pressure taken off, there is a pressure overbalance between the inside of the borehole and the formation pressure. This pressure overbalance will yet further assist holding the tubular member 9 in place.

Therefore, it can be seen that the apparatus 1 can be provided with an uninterrupted central mandrel section which couples to both the upper and lower ends of the tubular member 9, such as the one piece body section 5 of the first embodiment shown in FIG. 1, or can be provided with split upper 21 and lower 23 body sections which are respectively coupled to the upper and lower ends of the tubular member 9, such as the embodiment shown in FIG. 12. In the latter scenario, the opposing forces on the seals 13 are contained by, for instance slips (as indicated for the top seal 13), or a no go (as indicated for the bottom seal 13). Also, the length of the tubular member 9 is variable, depending upon conveyance technique, well geometry etc.

The expansion of the tubular member 9 against the inner surface of the liner 7 may provide a high integrity hydraulic fluid and/or gas seal therebetween, and this will particularly be the case when the tubular member 9 is expanded into recesses 27. However, the high integrity seal can be further aided by the provision of one or more elastomeric bands or rings around the outer circumference of the tubular member 9.

A first embodiment of a swage casing tie-back system 100 is shown in FIGS. 21 to 26 and is in accordance with the second and third aspects of the present invention.

Figures 21, 22, 23, 24, 25, 26:
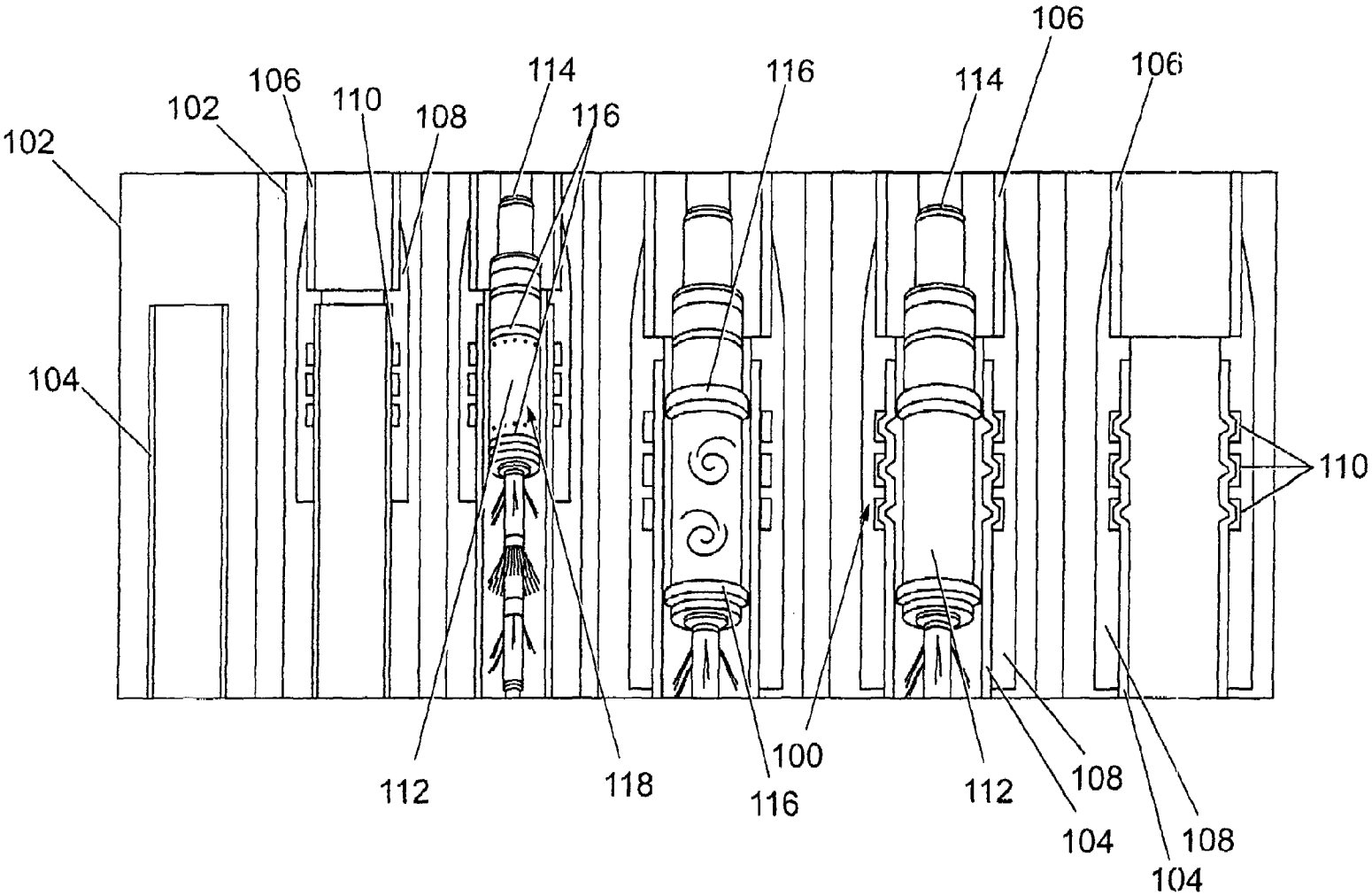
FIG. 21 is a schematic representation of a first embodiment of a tubular member such as a casing or liner string which has been cut downhole and which will have a "tie back" operation performed on it in accordance with a second aspect of the present invention.
FIG. 22 is a schematic representation of a swage overshot apparatus in accordance with the second aspect of the present invention being lowered over the upper end of the tubular member of FIG. 21.
FIG. 23 is a schematic representation of a packer in accordance with the second aspect of the present invention being lowered into position within the swage overshot apparatus of FIG. 22.
FIG. 24 is a more detailed schematic representation of the packer of FIG. 23 being actuated within the swage overshot apparatus.
FIG. 25 is schematic representation of the packer of FIG. 24 after actuation and after the tubular member has been swaged into formations provided within the swage overshot apparatus.
FIG. 26 is a schematic representation of the tubular member of FIG. 25 after the packer has been removed therefrom.

FIG. 21 shows a borehole 102 having a diameter of 12¼ inches which has been previously lined with a 9⅞ inch diameter casing string 104. However, it should be noted that the embodiments described below can be used with differently sized boreholes 102 and/or casing strings 104. Normally, as those skilled in the art will realise, the casing string 104 extends all the way up to the surface. However, in this case, the upper portion of the casing string (not shown) has been cut away from the lower portion of the casing string 104 and has been removed from the borehole 102. In some circumstances, casing strings can be backed off but in circumstances where the casing string failed to back-off, the swage casing tie-back system 100 would be utilised.

FIG. 22 shows that a tie-back casing string 106 has been run into the borehole 102, the casing string 106 having a swage overshot device 108 mounted at its lower end. The swage overshot device 108 is formed from a relatively tough material such as P110 grade steel and comprises a number (such as three as shown in FIG. 22) of internal recesses 110 or profiles formed on its inner bore. The rest of the internal bore of the overshot device 108 has a diameter just slightly larger than the outer diameter of the casing string 104 such that the overshot device 108 slips over the upper end of the casing string 104 like a sleeve.

FIG. 23 shows the next sequence of events where a body member comprising a packer tool 112 is run on the lower end of a string of drillpipe 114, down through the upper casing string 106 until the packer tool 112 is aligned with the annular recesses 110 of the overshot device 108. The packer tool 112 comprises a pair of seal elements 116 which are preferably longitudinally spaced apart by a distance which is slightly greater than the longitudinal distance between the uppermost annular recess 110 and the lowermost annular recess 110. An arrangement of apertures 118 which extend all the way through the side wall of the overshot device 108 are provided between the longitudinally spaced apart pair of seal elements 116.

FIG. 24 shows that the seal elements 116 have been actuated to form a seal between the outer surface of the packer tool 112 and the inner surface of the casing string 104 such that the annular region or chamber between the pair of seal elements 116 is sealed with respect to the annular region outside of the pair of seal elements 116. FIG. 24 also shows that water is pumped through the throughbore of the drillstring 114, into the interconnecting bore of the packer tool 112 and through the apertures 118 and into the annular region or chamber between the pair of seal elements 116. The water is continued to be pumped into the aforesaid chamber until the pressure reaches the desired level such as up to or perhaps even greater than 30,000 psi. As this hydraulic pressure increases, the force provided by it moves or swages the casing string 104 into the annular recesses 110 as shown in FIG. 25. Accordingly, the casing string 104 is now tied back to the casing string 106.

The pair of sealing elements 116 are then de-activated and the drillpipe string 114 and thus the packer tool 112 are removed from the casing strings 104, 106.

Thus, as shown in FIG. 26, the casing 104 is permanently expanded into the internal profile or recesses 110 of the overshot device 108 by firstly elastic deformation and secondly plastic deformation thus achieving a mechanical and pressure tight joint. Indeed, after the retrieval of the drillpipe 114 and the packer tool 112, the resulting joint has comparable mechanical integrity to the original casing string 104 and makes no reduction in internal diameter. Furthermore, the resulting joint provided is a metal to metal seal.

It should also be noted that the casing strings 104, 106 could be a string of liner tubings or production tubings or the like.

Figure 27:
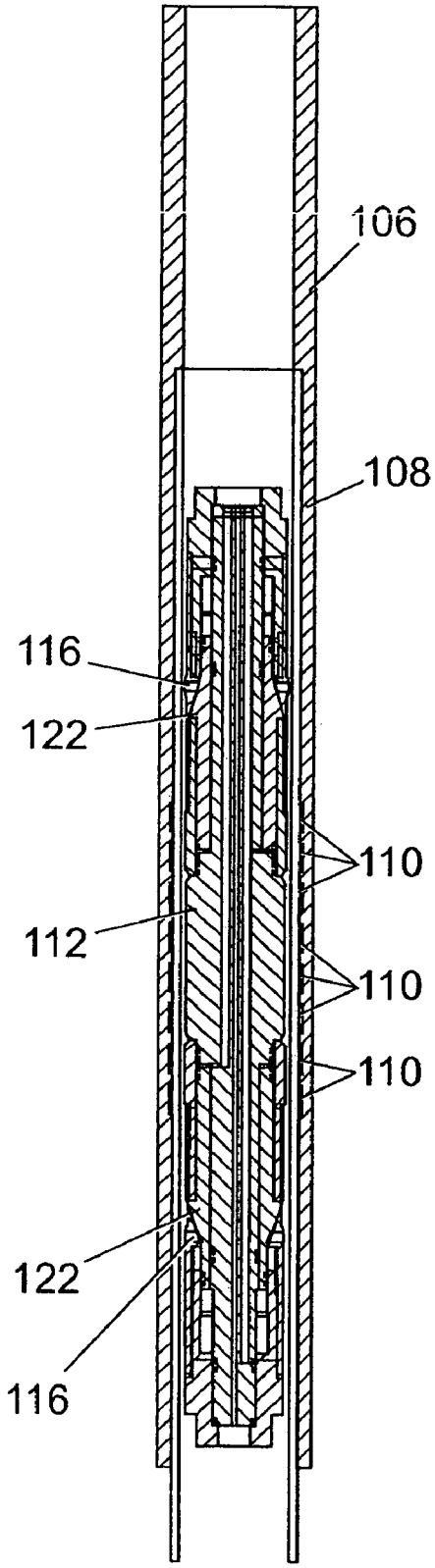
FIG. 27 is a more detailed longitudinal cross-sectional view of the packer of FIG. 23 prior to actuation in the running in hole configuration and within a tubular member.

FIG. 27 shows a first embodiment of a packer tool 112 in accordance with both the second and the third aspects of the present invention, although the lower end of the drillpipe string 114 is omitted for clarity purposes. It should be noted that the packer tool 112 is broadly the same as the packer tool 210 of FIGS. 28 and 29, although the skilled reader will realise that the pair of wedge members 122 of the packer 112 are arranged in the opposite direction to the pair of wedge members 222 of the packer 210. However, this does not effect the operation of the packer tool 112 compared with the packer 210. Accordingly, only the packer 210 will be described in detail.

Figure 28:
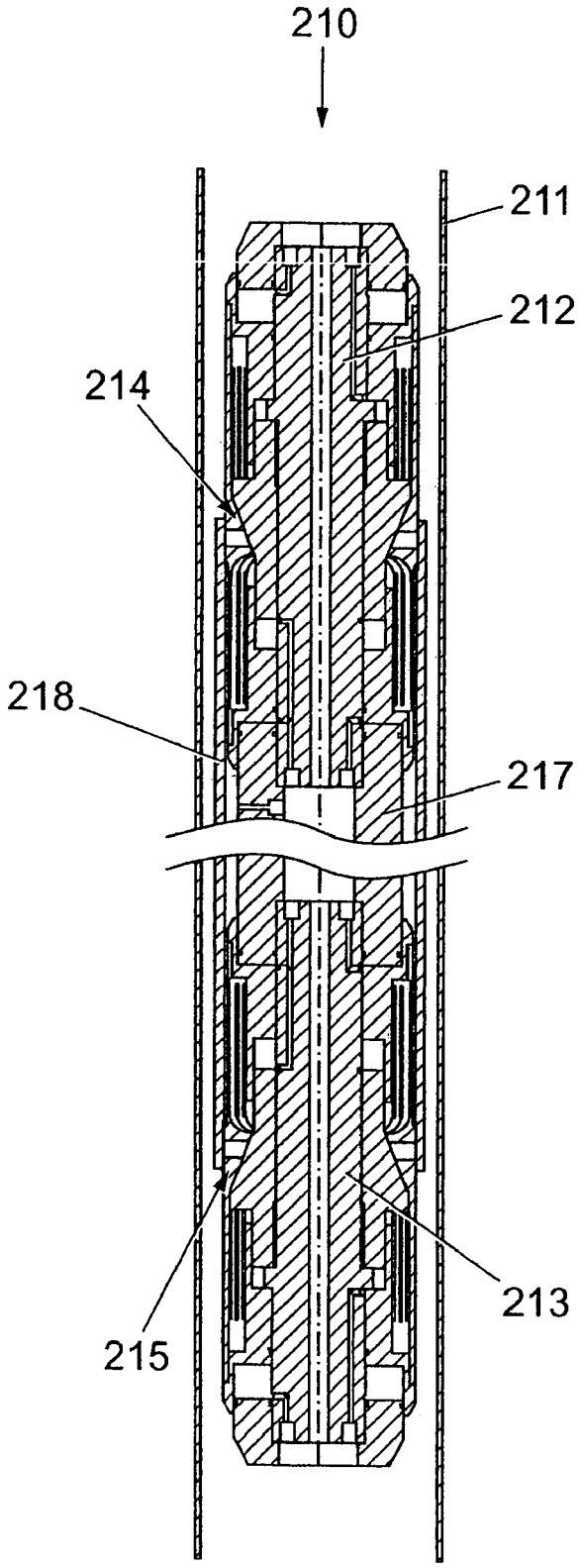
FIG. 28 is a further longitudinal cross-sectional view of the packer of FIG. 27 prior to actuation in the running in hole configuration.
Figure 29:
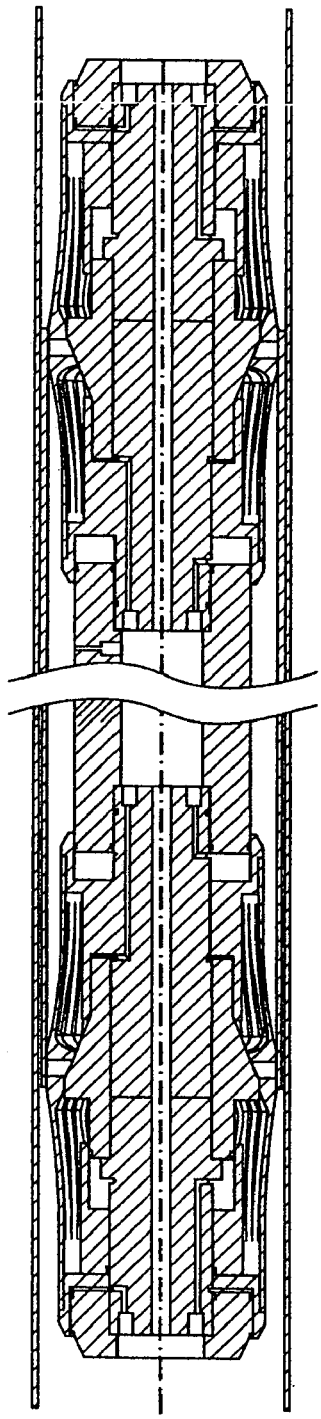
FIG. 29 is a longitudinal cross-sectional view of a very similar packer to the packer of FIG. 28 after actuation in a setting configuration.

FIG. 28 shows a packer tool 210 in accordance with the second and third aspects of the present invention disposed in an annular space, such as a production tube 211. The packer 210 comprises a first, upper, inner element 212 which acts as a piston, a second, lower, inner element 213 which also acts as a piston, a first seal assembly 214 and a second seal assembly 215, which will be described in detail further below. The two inner elements 212, 213 are telescopically coupled together by means of a mandrel 217. An annular sleeve 218 is disposed between the packer 210 and the production tube 211 in the longitudinal direction between the two seal assemblies 214 and 215. The annular sleeve 218 provides the sealing surface towards the production tube 211.

The inner, upper, element 212 will now be described with reference to FIG. 30. The inner element 212 is generally cylindrical and comprises moveable connection means in both ends for telescopical coupling to the mandrel 217 and other equipment, such as pipes, controlling means etc. respectively. In addition, the inner element 212 comprises a wedge member 222.

The seal assembly 214 (see FIG. 28) is slidable disposed on the outside of the inner element 212, and comprises an upper support sleeve 220, a lower support sleeve 221 and a seal 223. The seal 223 comprise an annular expandable ring, preferably made of expandable and temperature resistant materials.

Figure 30:
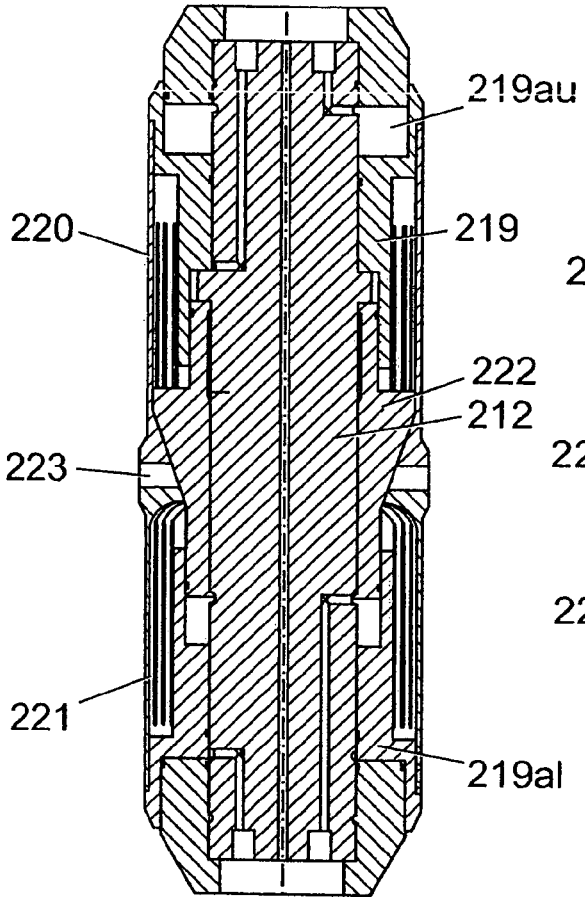
FIG. 30 is a part longitudinal cross-sectional view of the seal assembly and the inner element of the packer of FIG. 29 in running position.
Figure 31:
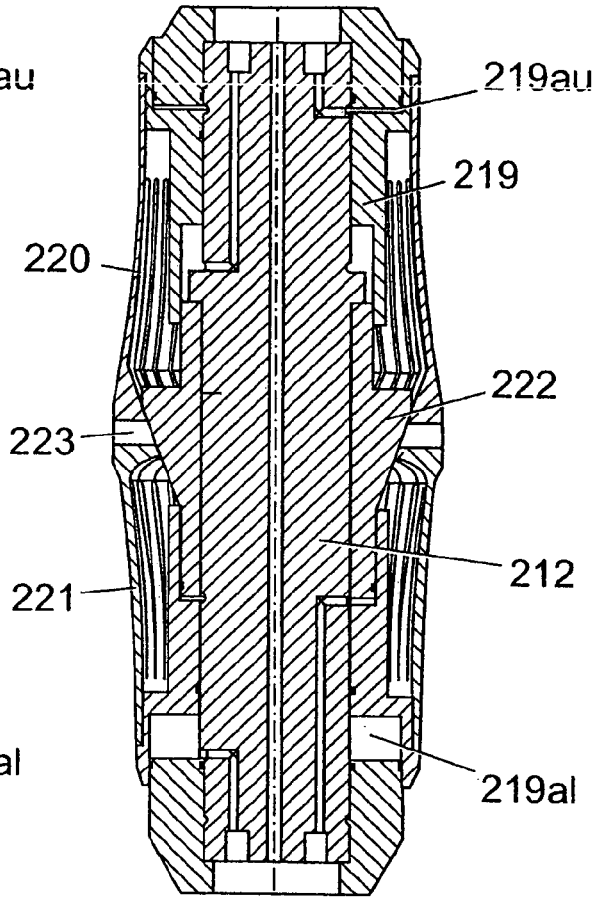
FIG. 31 is a part longitudinal cross-sectional view of the seal assembly and the inner element of the packer of FIG. 29 in setting position.

Between the seal assembly 214 and the inner element 212 there are disposed displacement means 219 (shown in FIGS. 30 and 31. The displacement means 219 operates the sliding of the seal assembly 214 relative to the inner element 212. In this embodiment the displacement means is a hydraulic drive, and FIGS. 30 and 31 show upper hydraulic fluid chambers 219*au* and lower hydraulic fluid chambers 219*al* which are selectively pressurised with respective hydraulic fluid delivered from surface via hydraulic lines (not shown). For instance, in order to actuate the seal assembly, pressurised fluid is forced into chamber 219*al* which forces the inner element 212 downwards from the position shown in FIG. 30 to the position shown in FIG. 31 thus forcing the seal 223 to expand outwards due to the wedge member 222 action upon it.

Figure 32:
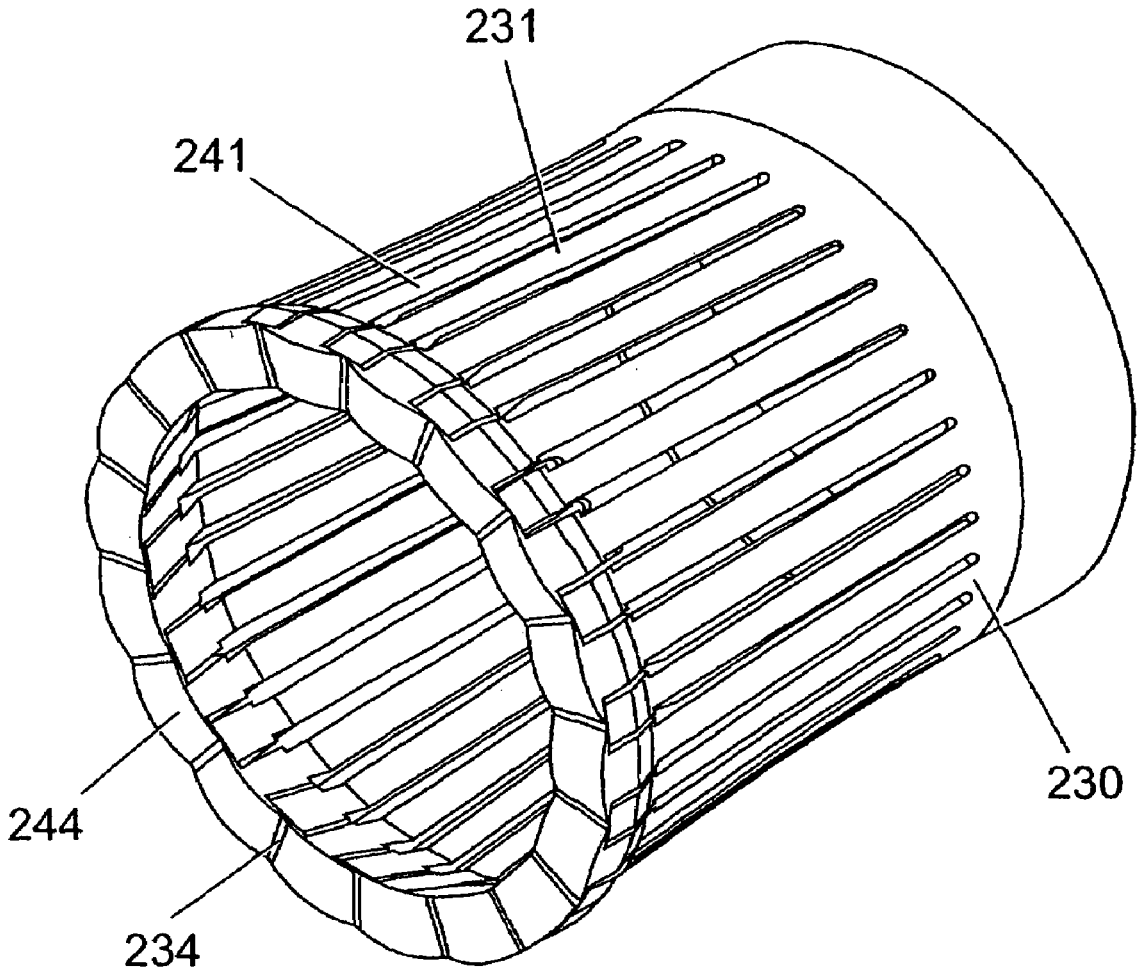
FIG. 32 is a perspective view of the support ring for the seal assembly of the packer of FIG. 29.

The support sleeves 220, 221 form the expandable parts of the seal assembly together with the seal 223. The support sleeves 220, 221 preferably comprise fingers of two different types, where every second finger is of the same type. The fingers are all connected to an end 230 of the support sleeve. This is shown in detail in FIG. 32.

The first finger type 231 comprises an elongated member 232. In the end opposite to the end 230 of the support sleeve 220, the first finger 231 comprises a generally triangular support member 233, the end surface of which defines a support surface 234.

The second finger type 241 comprises an elongated member 42. In the end opposite to the end 230 of the support sleeve 220, the second finger 241 comprises a generally triangular support member 243. The support member 243 is differing from the support member 233 in that it is generally T-shaped seen from above (FIG. 33*c*). The end of the support member 243 defines a support surface 244, and the other side of the support member 433 defines a support surface 245. Preferably, the crossbars of the T-shaped support members 243 of the different second type fingers 241 are lying next to each other in the running in hole position.

The operation of the packer will now be described with reference to FIGS. 30 and 31.

FIG. 30 shows the upper part of the packer 210 in the running in hole position. Here, the annular seal 223 particularly rests on the support surfaces 244 of the second type fingers 241. The support surfaces 245 of the second type fingers 241 are further resting on the support surface 234 of the first type finger 231. The annular seal 223 is in the radially inward direction resting on the wedge member 222 and in the radially outward direction resting on the annular sleeve 218 (FIG. 28).

When the desired position of the packer 210 in the production tube 211 is found, a compression force is applied to the packer 210 by means of the displacement means 219. The compressive force results in a downwardly directed displacement of the support sleeve 220 and compression of the support sleeve 221 in FIG. 30. Consequently, the support sleeve 221 together with the annular seal 223 climbs the wedge member 222, which again causes the annular seal 223 and the fingers 231, 241 of the support sleeves 220, 221 to expand radially.

The expansion of the support sleeves 220, 221 is shown in FIG. 31. The annular seal 223 is now expanded to a larger radius, but has substantially the same shape as the previous form. This is due to the support sleeves 220, 221. Since the fingers of the support sleeves 220, 221 have their mutual distance increased, the crossbars of the T-shaped support members 243 of the different second type fingers 241 have their mutual distance increased. The annular seal 223 is now resting on both the support surfaces 234 of the first type finger 231 and the support surface 244 of the second type finger 244. Preferably, the support surfaces 245 are also still resting on the support surfaces 234, even though the contact surface between them has decreased.

Consequently, the annular seal 223 is still supported in the desired position in a way that prevents extrusions of the seal 223, even under high pressure.

Accordingly, the expansion of the seal assemblies 214, 215 causes the sleeve 218 to be pressed out towards the casing or production tube with a large force, and the seal 223 is now in the setting position.

The operation from the setting position to the running position is achieved by reducing the compression force on the displacement means 219, by means of relieving the pressure in chambers 219*al* and increasing the pressure in chambers 219*au* which causes the inner element 212 to move upwardly again to the position shown in FIG. 30. As the annular seal 223 slides down the wedge member 222 the radius of the seal 223 will decrease and consequently the fingers 231, 241 of the sleeves 220, 221 will go back to their original position.

Figure 33A:
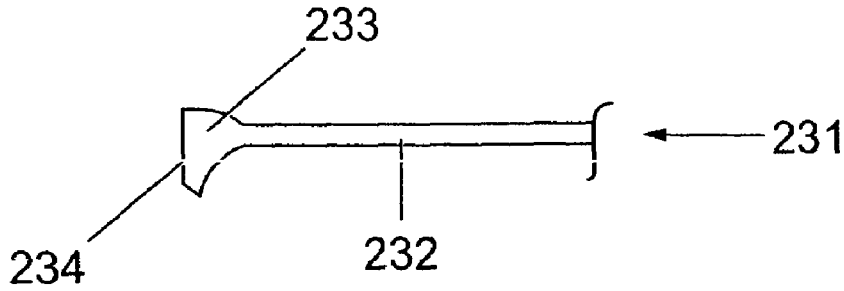
FIG. 33*a* shows a first finger type seen from the side.
Figure 33B:
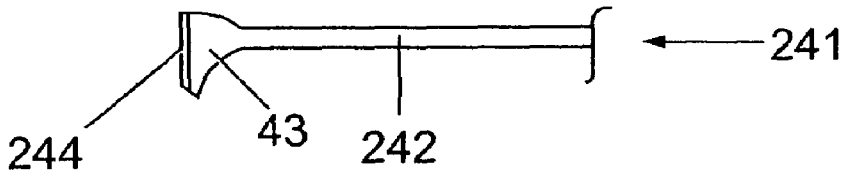
FIG. 33*b* shows a second finger type from the side.
Figure 33C:
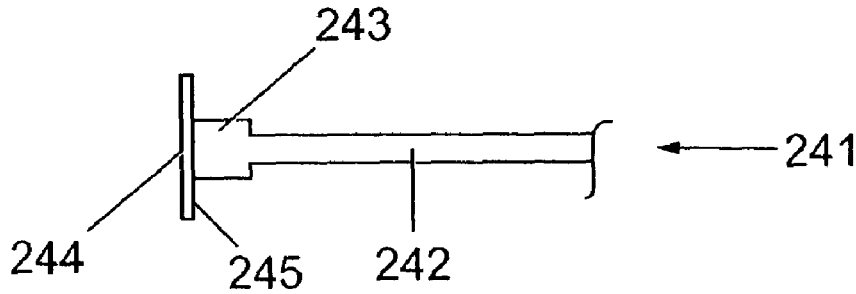
FIG. 33*c* shows the second finger type of FIG. 33*b* from above.

In FIGS. 33*a* and 33*c* the support surfaces 234 and 244 are shown generally perpendicular to their respective elongated members 232 and 242. These support surfaces may of course have an angle with their elongated members.

It should be noted that the production tube 211 could be a casing string or liner string or the like.

Modifications and improvements may be made to the embodiments without departing from the scope of the invention. For instance, the packer tool 112 and/or the packer tool 210 of FIGS. 27 and 28 respectively could be modified to provide a plug (not shown) in accordance with a fourth aspect of the present invention and in this case, embodiments thereof could comprise a single seal assembly 116 and 214/215 respectively, where the plug could be run on drill pipe, coil tubing or wireline. Setting of the plug would be via hydraulic or mechanical means. A seal setting piston (not shown) would be attached to a mandrel (not shown) that protrudes through the top of the single seal assembly of the plug. This mandrel would be attached to a setting tool, such that when the mandrel is pulled upwards against a sleeve (not shown) acting on the top of the seal assembly, the seal is activated and is extruded outwardly to contact the casing wall, for instance.

Final setting loads of the plug would vary, depending on the differential pressure requirements. These final setting loads could be set via either a mechanical shear stud (not shown) when set mechanically or via final hydraulic pressure when set with hydraulics. The seal setting piston would be maintained in the set position via locking the hydraulics in place for a hydraulic set or with slips or a ratchet mechanism for mechanical sets.

For retrieval of the plug, the seals would be de-activated via releasing the hydraulic pressure or by releasing the ratchet/slip mechanism.

For high differential pressures, the setting force would be sufficiently high to swage the casing with the single seal assembly, thereby key seating the seal assembly into the well delivering a large resistance to movement up or down the well.

The invention claimed is:

1. An apparatus for expanding and fixing a tubular member into an inner surface of a liner or borehole, the apparatus comprising:

a body adapted to be located co-axially within the tubular member wherein a pair of seal means are mounted upon the body and are adapted to be selectively energised to seal against the inner surface of the tubular member to be expanded;

and a pressure control means operable to increase the pressure of fluid within the tubular member between the pair of energised seal means, such that operation of the pressure control means causes the tubular member to move radially outwardly such that the tubular member undergoes elastic deformation and also plastic deformation, to expand the tubular member beyond it's yield point, to bear against the inner surface of the liner or borehole wall;

wherein the seal means are capable of being de-energised and the body and pair of seal means are capable of being removed from within the tubular member and liner or borehole such that the tubular member remains fixed to the inner surface of the liner or borehole.

2. Apparatus according to claim 1, wherein the body member comprises an upper body section and a separate lower body section, and one of the said pair of seal means is mounted upon each of the upper and lower body sections.

3. Apparatus according to claim 1, wherein when the liner or borehole is a liner, the liner is provided with a surface that facilitates providing engagement between the liner and the tubular member.

4. A method of expanding and fixing a tubular member into the inner surface of a liner or borehole of a well, the method comprising the steps of:

inserting the tubular member into the borehole;

locating a body co-axially within the tubular member wherein a pair of seal means are mounted upon the body and are adapted to be selectively energised to seal against the inner surface of the tubular member to be expanded;

energising the pair of seal means to create a chamber within the tubular member; and increasing the pressure of fluid within the chamber, such that the pressure increase causes the tubular member to move radially outwardly such that the tubular member undergoes elastic deformation and also plastic deformation, to expand the tubular member beyond it's yield point, to bear against the inner surface of the liner or borehole;

de-energising the seal means; and removing the body and pair of seal means from within the tubular member and liner or borehole such that the tubular member remains fixed to the inner surface of the liner or borehole.

5. A method according to claim 4, further comprising inserting the tubular member into the liner or borehole to the required depth by way of one of wireline, coil tubing and drill pipe.

6. A method according to claim 4, wherein when the liner or borehole is a liner, the method further comprises continuing with the step of increasing the pressure of fluid within the chamber until the liner undergoes elastic deformation such that a seal is formed between the inner surface of the liner and the outer surface of the tubular member when the pressure of the fluid is reduced.

7. A method according to claim 4, further comprising the step of providing the liner with a surface that facilitates engagement between the liner and the tubular member.

8. A method according to claim 6, wherein the method further comprises continuing with the step of increasing the pressure of fluid within the chamber until both of the liner and tubular member undergo plastic deformation.

9. An apparatus for securing a first tubular member to a second tubular member already located within a liner or borehole of a well, the apparatus comprising:

a pair of seal means associated with the first tubular member;

and a pressure control means operable to increase the pressure within the first tubular member between the pair of seal means;

such that operation of the pressure control means causes the first tubular member to move radially outwardly to bear against an inner surface of the second tubular member;

wherein the pair of seal means are mounted on a body member and are capable of alignment downhole with one or more profiles formed on a surface of the first tubular member; and wherein the pair of seal means are capable of actuation to seal against the inner bore of the second tubular member, and the body member is provided with one or more fluid ports or apertures formed in its sidewall, such that a fluid is capable of being pumped through the first tubular member, through the one or more fluid ports and into a chamber defined between the outer surface of the body member, the inner bore of the first tubular member and the pair of seal means.

10. Apparatus according to claim 9, wherein the pair of seal means are longitudinally spaced apart on the body member and the pair of seal means are arranged such that they are spaced further apart than the longitudinal extent of the one or more profiles.

11. Apparatus according to claim 9, wherein one or more portions of the first tubular member are expandable into a respective number of the one or more profiles of the second tubular member to form a joint between the first tubular member and the second tubular member.

12. Apparatus according to claim 11, wherein the one or more portions of the second tubular member are expandable radially outwardly such that the one or more portions undergo elastic deformation and also plastic deformation.

13. A method of securing a first tubular member to a second tubular member already located within a liner or borehole of a well, the method comprising:

inserting the first tubular member into the borehole such that a lower end thereof is in close proximity with an upper end of the second tubular member; and increasing the pressure within the second tubular member between a pair of seal means associated with the second tubular member, such that the pressure increase causes the second tubular member to move radially outwardly to bear against an inner surface of the first tubular member;

wherein the pair of seal means are mounted on a body member, and lowering the body member into the well through the first tubular member by an elongate member and further lowering the body member into the second tubular member;

lowering the body member proximate to the upper end of the second tubular member until the body member is generally aligned with one or more profiles formed on an internal surface of the first tubular member;

wherein the pair of seal means are longitudinally spaced apart on the body member and the pair of seal means are arranged such that they are spaced further apart than the longitudinal extent of the one or more profiles, and lowering the body member into the first tubular member until the pair of seal means straddle the one or more profiles;

actuating the pair of seal means to seal against the inner bore of the second tubular member; and using a fluid to provide the pressure and pumping the fluid through the first tubular member, through one or more fluid ports provided in a sidewall of the body member and into a chamber defined between the outer surface of the body member, the inner bore of the second tubular member and the pair of seal means.

14. A method according to claim 13, wherein, once the pressure has increased to a sufficient level, expanding one or more circumferential portions of the first tubular member into a respective number of the one or more profiles of the second tubular member to form a joint between the first tubular member and the second tubular member.

15. A method according to claim 14, wherein the one or more portions of the second tubular member are moved radially outwardly such that the one or more portions undergo elastic deformation and also plastic deformation.

16. A method of securing a first tubular member to a second tubular member already located within a liner or borehole of a well, the method comprising:

inserting the first tubular member into the borehole such that a lower end thereof is in close proximity with and is located co-axially outside of an upper end of the second tubular member;

providing a pair of seal means on a body member, and lowering the body member into the well through the first tubular member by an elongate member and further lowering the body member into the second tubular member;

actuating the pair of seal means against an inner surface of the second tubular member; and increasing the pressure within the second tubular member between the pair of seal means, such that the pressure increase causes the second tubular member to move radially outwardly to bear against an inner surface of the first tubular member, further comprising pulling the elongate member and the body member and the pair of seal means out of the well.

17. A packer device for use in an annular space, where the packer device comprises at least one substantially cylindrical inner element, at least one seal assembly and a displacement means operable to apply a compression force on the said seal assembly, where the said inner element comprises a wedge member, and the said seal assembly is slidable over the wedge member along the longitudinal direction of the at least one inner element, wherein the said seal assembly expands radially outward when forced over the wedge member, the seal assembly comprising a radially expandable annular seal supported by radially expandable support sleeves, wherein the support sleeves comprise fingers supporting the said annular seal, characterised in that the support sleeves comprise at least two types of fingers forming a substantially continuous support surface towards the said annular seal in both expanded and non-expanded positions.

18. A packer device according to claim 17, wherein the displacement means is disposed between the said inner element and the said seal assembly and the fingers are connected to an end of their respective support sleeve.

19. A packer device according to claim 17, wherein the first type of finger comprises a generally triangular support member, the end surface of which defines a support surface and the second type of finger preferably comprises a generally triangular support member being generally T-shaped seen from above, the end of which defines a support surface, where the other side of the support member defines a support surface.

20. A packer device according to claim 17, wherein there are at least two packer devices connected by means of a mandrel and an annular sleeve is disposed between the at least two packer devices and a tubular string into which the packer device is run, said annular sleeve being disposed in a longitudinal direction between two seal assemblies, wherein the annular sleeve provides a sealing surface towards the tubular string.

21. A packer device according to claim 17, wherein an isolation plug is provided which comprises one packer device which is run into a downhole well on an elongate member.

22. A packer device according to claim 19, wherein every second finger of the support sleeve is of the first type of finger, or the second type of finger respectively.

23. A packer device according to claim 22, wherein the support surfaces of the second type of fingers in a running in hole position rest on at least some of the support surfaces of the first type of fingers.

24. A packer device according to claim 21, wherein the displacement mechanism is operable to expand the said annular seal in a radially outwards direction toward a downhole tubular to seal against an inner bore thereof in order to plug the downhole tubular.

25. A packer device according to claim 24, wherein the displacement mechanism comprises a seal setting piston which is attached to a mandrel which protrudes through an upper end of the packer device and the mandrel is attached to a setting tool, such that when, in use, the mandrel is pulled upwards against a sleeve mounted against the upper end of the packer device, the seal means is activated and is extruded outwardly to contact the downhole tubular.

26. An apparatus for securing a first tubular member to a second tubular member already located within a borehole of a well, the apparatus comprising:

a body adapted to be located co-axially within the first tubular member wherein a pair of seal means are mounted upon the body and are adapted to be selectively energised to seal against the inner surface of the first tubular member;

and a pressure control means operable to increase the pressure of fluid within the first tubular member between the pair of energised seal means, such that operation of the pressure control means causes the first tubular member to move radially outwardly such that the first tubular member undergoes elastic deformation and also plastic deformation, to expand the first tubular member beyond it's yield point, to bear against the inner surface of the second tubular member; and the apparatus being arranged such that the second tubular member undergoes elastic and thereafter plastic deformation following continued application of pressure of fluid wherein a seal is formed between the inner surface of the second tubular member and the outer surface of the first tubular member when the pressure of fluid is reduced;

wherein the seal means are capable of being de-energised and the body and pair of seal means are capable of being removed from within the first and second tubular members and borehole such that the first tubular member remains fixed to the inner surface of the second tubular member.

27. A method of expanding and fixing a first tubular member to an inner surface of a second tubular member already located within a borehole of a well, the method comprising:

locating a body co-axially within the first tubular member, the body comprising a pair of seal means mounted thereon, the pair of seal means being adapted to be selectively energised to seal against the inner surface of the first tubular member;

energising the pair of seal means to create a chamber within the first tubular member;

increasing the pressure of fluid within the chamber such that the pressure increase causes the first tubular member to move radially outwardly such that the first tubular member undergoes elastic deformation and also plastic deformation, to expand the tubular member beyond it's yield point, to bear against the inner surface of the second tubular member; and continuing to apply pressurized fluid within the chamber such that the second tubular member undergoes elastic and thereafter plastic deformation wherein a seal is formed between the inner surface of the second tubular member and the outer surface of the first tubular member when the pressure of fluid is reduced.

28. A method according to claim 27, further comprising:

de-energising the seal means; and removing the body and pair of seal means from within the first tubular member and borehole such that the first tubular member remains fixed to the inner surface of the second tubular member.

* * * * *